US010900637B2

(12) United States Patent
Im et al.

(10) Patent No.: US 10,900,637 B2
(45) Date of Patent: Jan. 26, 2021

(54) LIGHTING DEVICE

(71) Applicant: LG INNOTEK CO., LTD., Seoul (KR)

(72) Inventors: Chang Hyuk Im, Seoul (KR); Young Kuk Kwak, Seoul (KR); Ki Woong Kim, Seoul (KR); Cheon Joo Kim, Seoul (KR); Hwa Young Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 274 days.

(21) Appl. No.: 15/762,981

(22) PCT Filed: Sep. 22, 2016

(86) PCT No.: PCT/KR2016/010571
§ 371 (c)(1),
(2) Date: Mar. 23, 2018

(87) PCT Pub. No.: WO2017/052220
PCT Pub. Date: Mar. 30, 2017

(65) Prior Publication Data

US 2019/0301719 A1 Oct. 3, 2019

(30) Foreign Application Priority Data

Sep. 25, 2015 (KR) ..... 10-2015-0136317
Sep. 25, 2015 (KR) ..... 10-2015-0136321
(Continued)

(51) Int. Cl.
*F21V 7/04* (2006.01)
*F21V 29/70* (2015.01)
(Continued)

(52) U.S. Cl.
CPC ..... *F21V 7/04* (2013.01); *F21K 9/62* (2016.08); *F21K 9/65* (2016.08); *F21K 9/66* (2016.08);
(Continued)

(58) Field of Classification Search
CPC ... F21V 7/04; F21V 29/70; F21V 7/24; F21V 3/062; F21V 7/0008; F21V 7/06;
(Continued)

(56) References Cited

U.S. PATENT DOCUMENTS

2009/0303737 A1 12/2009 Ladstätter et al.
2011/0222267 A1 9/2011 Park et al.
(Continued)

FOREIGN PATENT DOCUMENTS

CN 102588821 A 7/2012
CN 202361183 U 8/2012
(Continued)

OTHER PUBLICATIONS

International Search Report (PCT/ISA/210) issued in PCT/KR2016/010571, dated Jan. 16, 2017.

*Primary Examiner* — Cara E Rakowski
*Assistant Examiner* — Jessica M Apenteng
(74) *Attorney, Agent, or Firm* — Birch, Stewart, Kolasch & Birch, LLP

(57) ABSTRACT

A lighting device according embodiments comprises: a housing including first and second back covers having arcuate inner surfaces; a recess opened to the lower portions of the first and second back covers; a transparent sheet disposed in a diagonal line configuration on the recesses of the first and second back covers; a light emitting module between the recesses of the first and second back covers; a heat dissipating body on which the light emitting module is disposed; and a first reflective sheet reflecting light onto
(Continued)

inner surfaces of the first and second back covers, wherein the heat dissipating body includes a heat dissipation part having the first and second light emitting modules disposed thereon, and a reflective part disposed between the heat dissipating part and the bottom portion of the transparent sheet, and the first reflective sheet has multiple reflective surfaces.

20 Claims, 20 Drawing Sheets

(30) Foreign Application Priority Data

Sep. 25, 2015 (KR) ..... 10-2015-0136323
Sep. 25, 2015 (KR) ..... 10-2015-0136324

(51) Int. Cl.

| | |
|---|---|
| ***F21K 9/66*** | (2016.01) |
| ***F21V 3/06*** | (2018.01) |
| ***F21V 7/00*** | (2006.01) |
| ***F21V 7/06*** | (2006.01) |
| ***F21V 7/09*** | (2006.01) |
| ***F21V 17/10*** | (2006.01) |
| ***F21K 9/65*** | (2016.01) |
| ***F21S 2/00*** | (2016.01) |
| ***F21V 17/16*** | (2006.01) |
| ***F21K 9/62*** | (2016.01) |
| ***F21V 15/01*** | (2006.01) |
| ***F21V 7/24*** | (2018.01) |
| *F21Y 115/10* | (2016.01) |

(52) U.S. Cl.
CPC ..... *F21S 2/00* (2013.01); *F21V 3/062* (2018.02); *F21V 7/0008* (2013.01); *F21V 7/06* (2013.01); *F21V 7/09* (2013.01); *F21V 7/24* (2018.02); *F21V 15/01* (2013.01); *F21V 17/10* (2013.01); *F21V 17/16* (2013.01); *F21V 29/70* (2015.01); *F21Y 2115/10* (2016.08)

(58) Field of Classification Search
CPC ..... F21V 7/09; F21K 9/66; F21K 9/62; F21K 9/65; F21S 2/00
USPC ..... 362/234
See application file for complete search history.

(56) References Cited

U.S. PATENT DOCUMENTS

| | | | | |
|---|---|---|---|---|
| 2012/0051041 | A1* | 3/2012 | Edmond ..... | F21V 29/745 362/231 |
| 2012/0081912 | A1 | 4/2012 | Yamamoto et al. | |
| 2015/0138829 | A1* | 5/2015 | Jang ..... | G02B 6/0021 362/606 |

FOREIGN PATENT DOCUMENTS

| | | | |
|---|---|---|---|
| CN | 203980038 | U | 12/2014 |
| JP | 2007-300138 | A | 11/2007 |
| KR | 10-2012-0024744 | A | 3/2012 |
| KR | 10-2012-0051500 | A | 5/2012 |
| KR | 10-2012-0082774 | A | 7/2012 |
| KR | 10-2013-0103918 | A | 9/2013 |
| KR | 10-2015-0027521 | A | 3/2015 |
| KR | 10-2015-0041317 | A | 4/2015 |

* cited by examiner

【Figure 1】
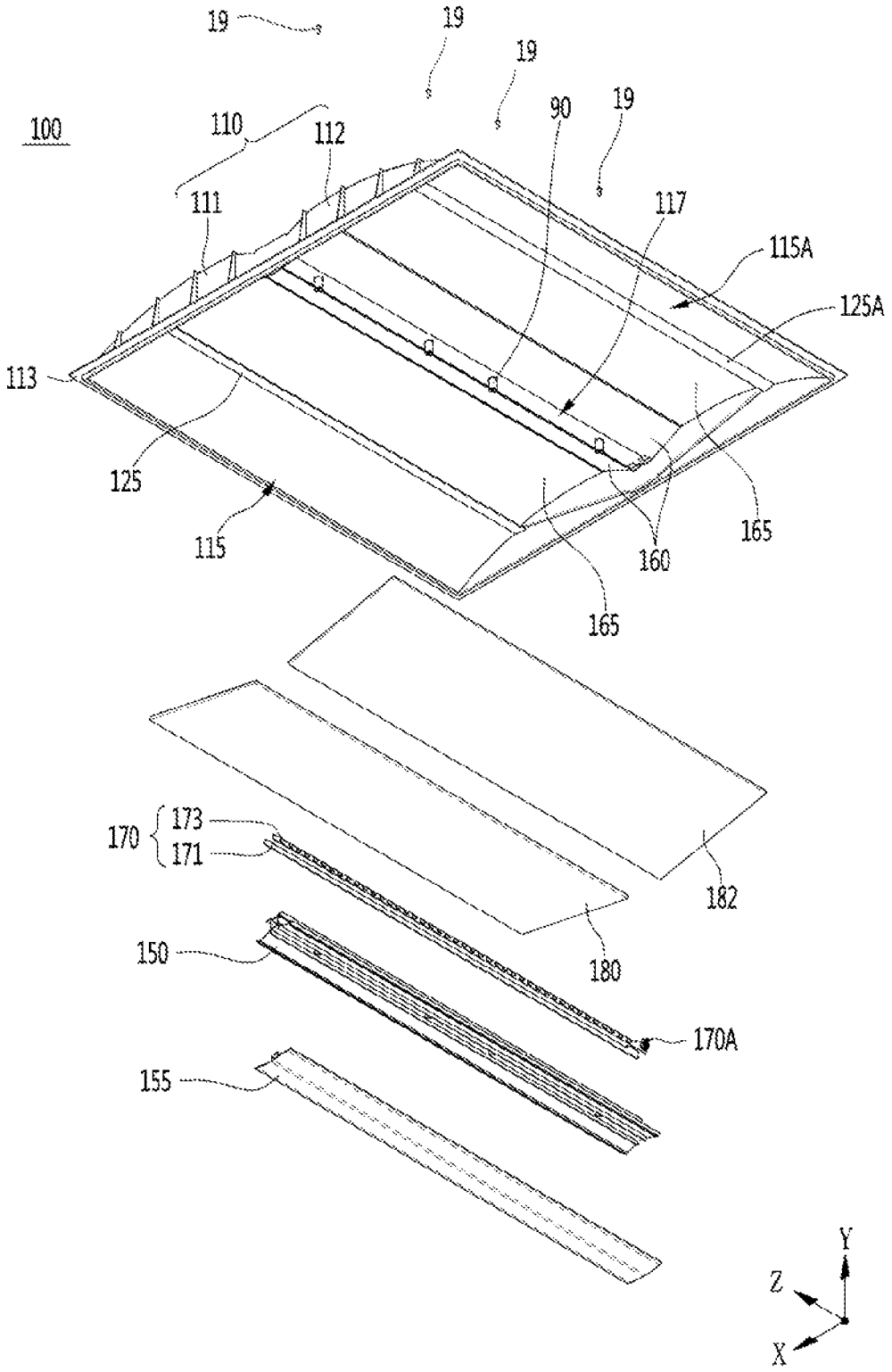

【Figure 2】
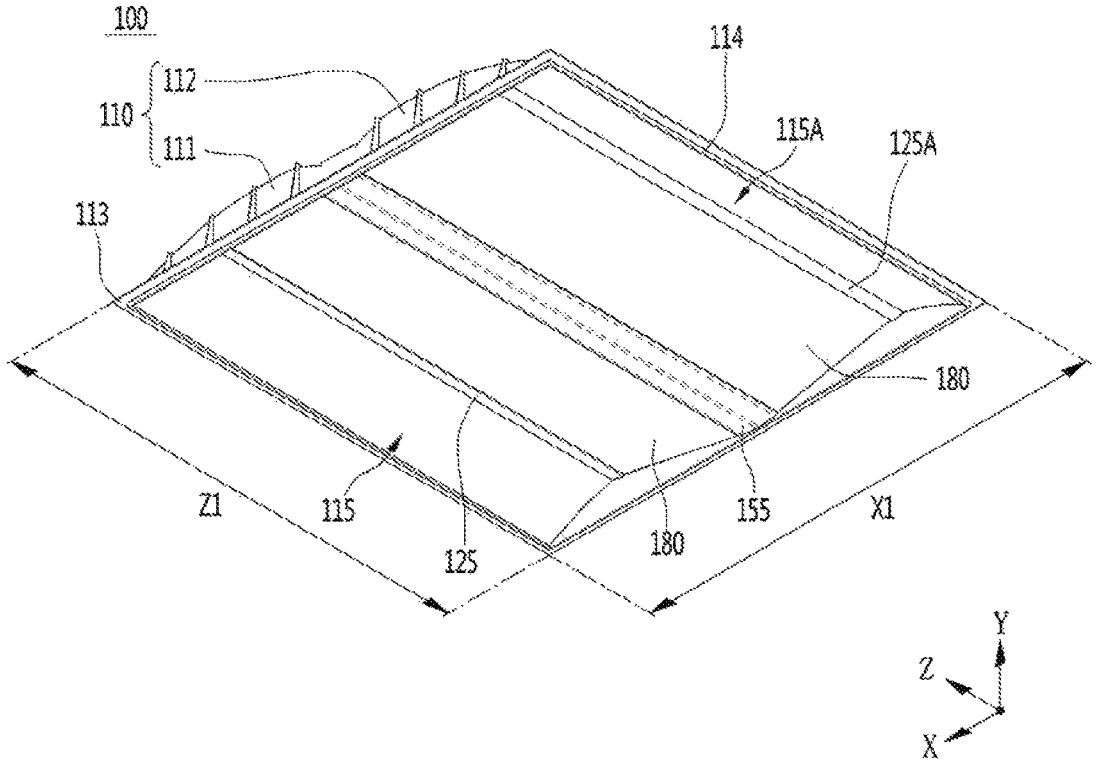

【Figure 3】
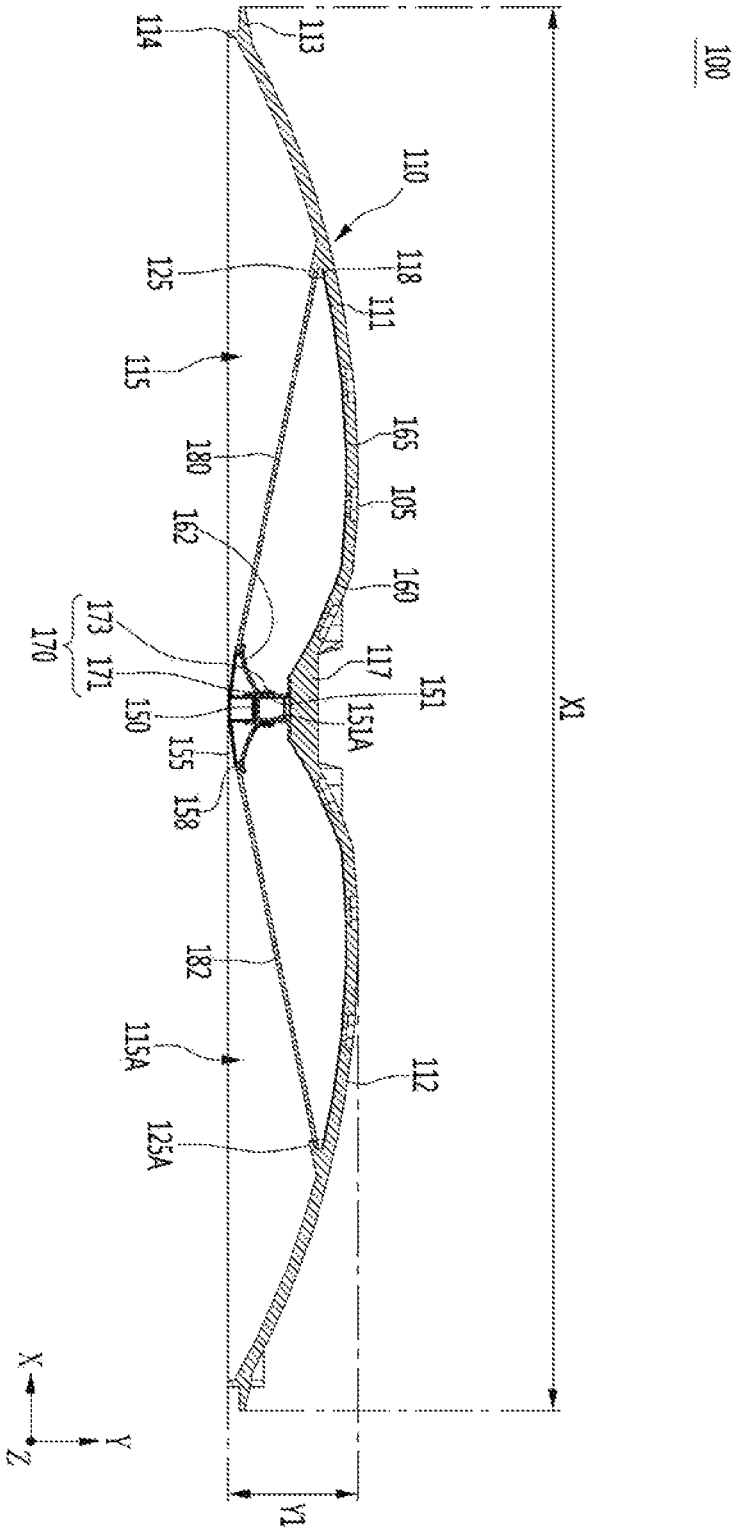

【Figure 4】
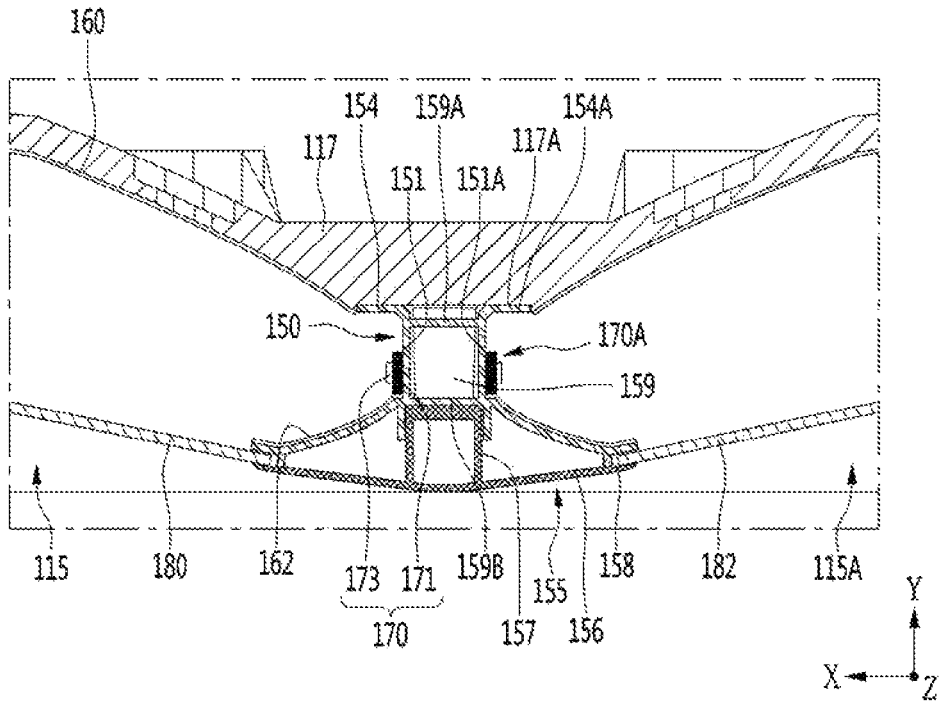
【Figure 5】
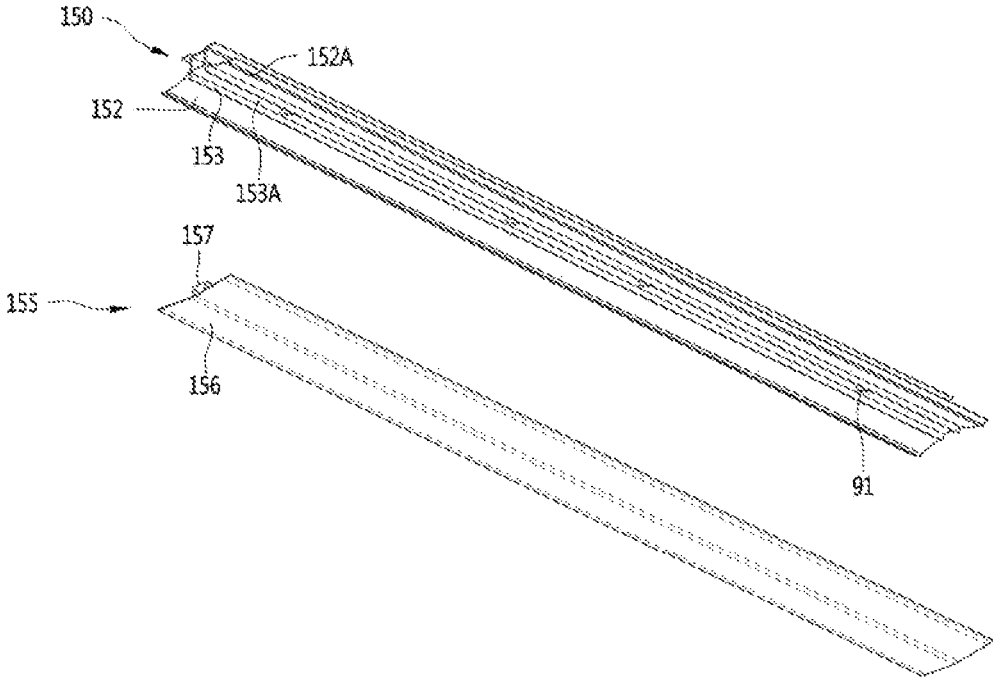

【Figure 6】
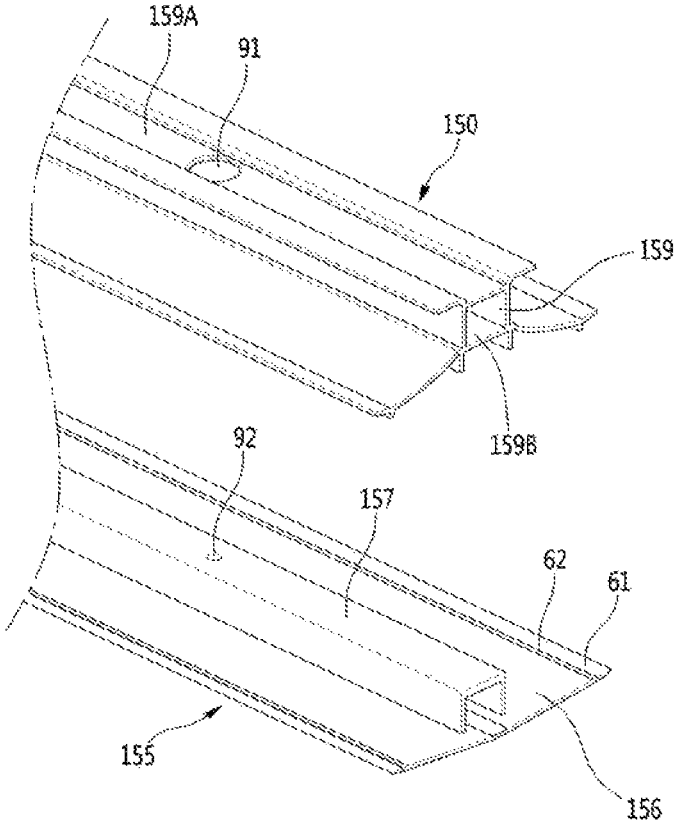

【Figure 7】
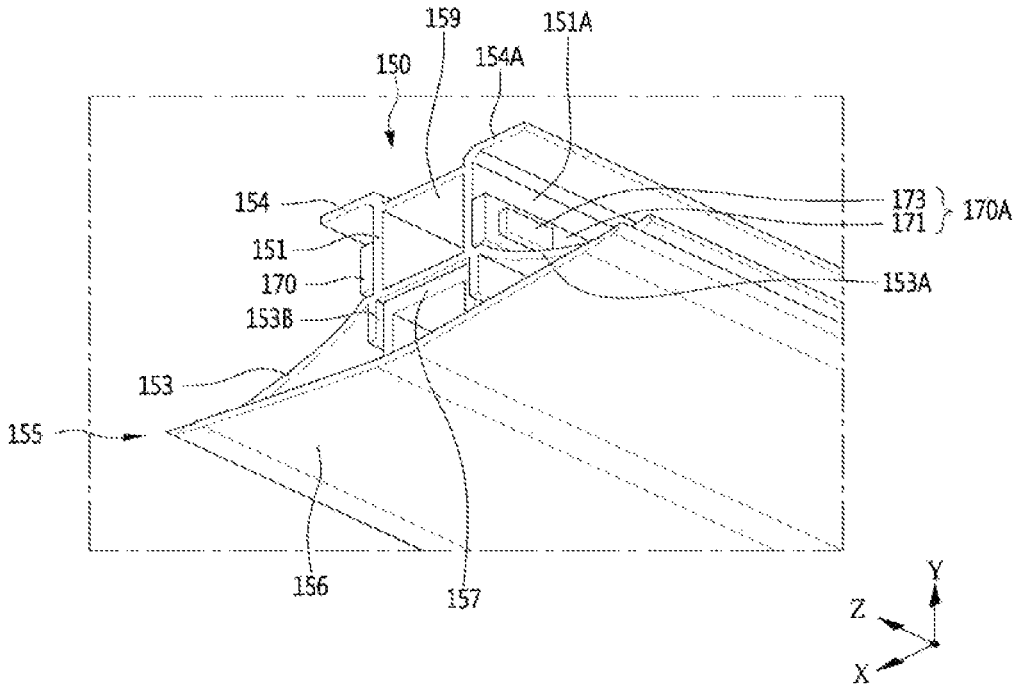

【Figure 8】
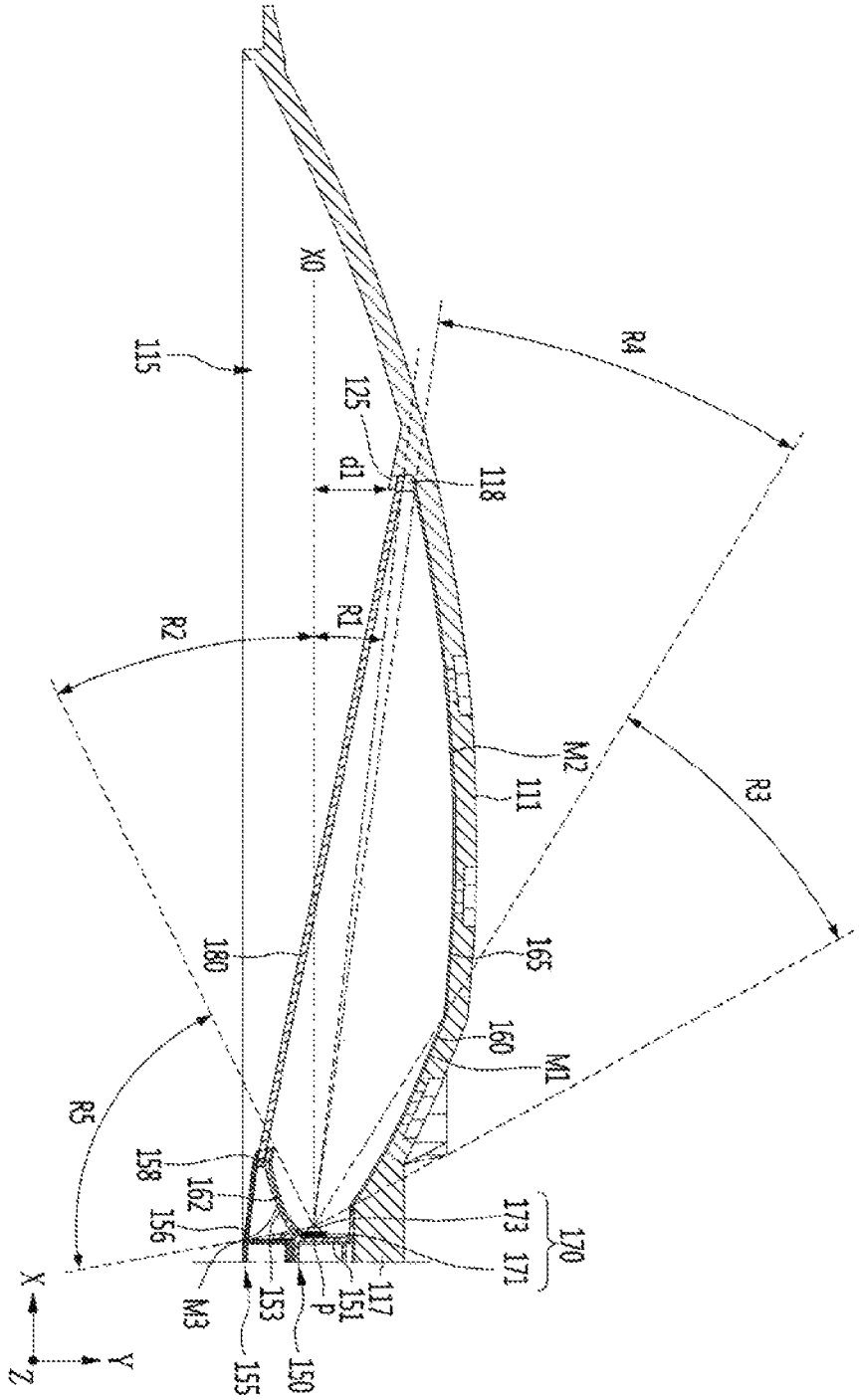

【Figure 9】
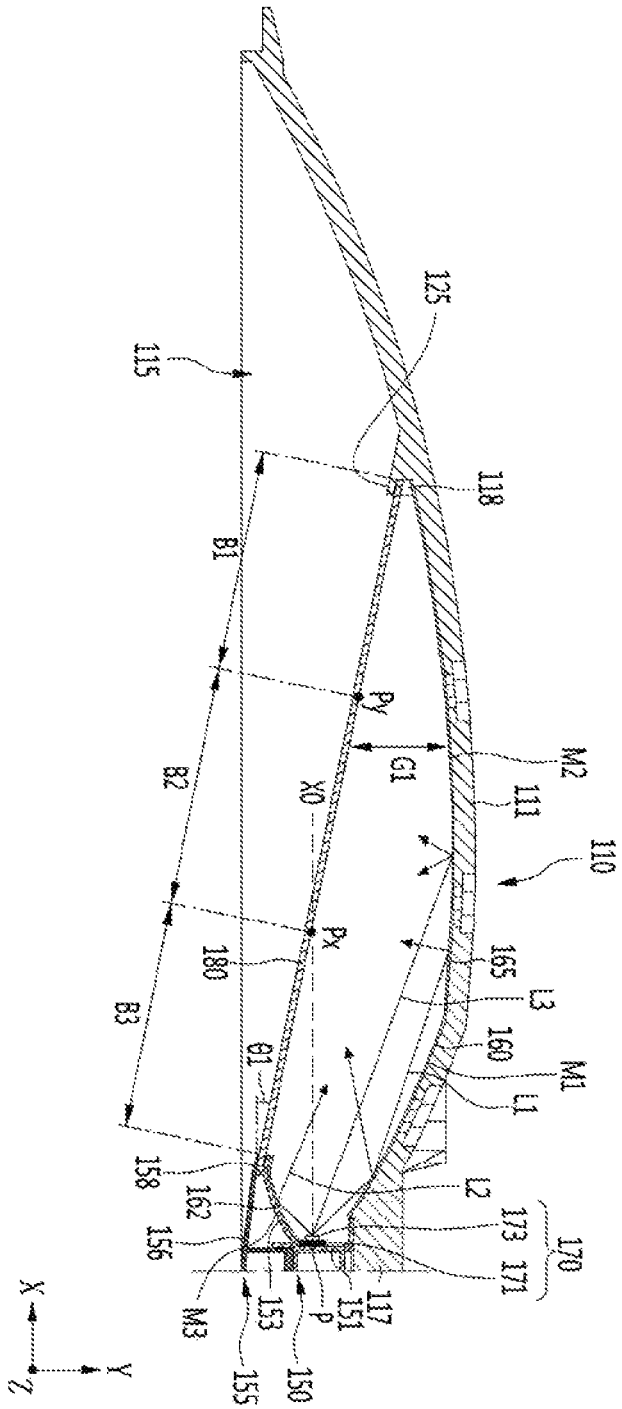

【Figure 10】
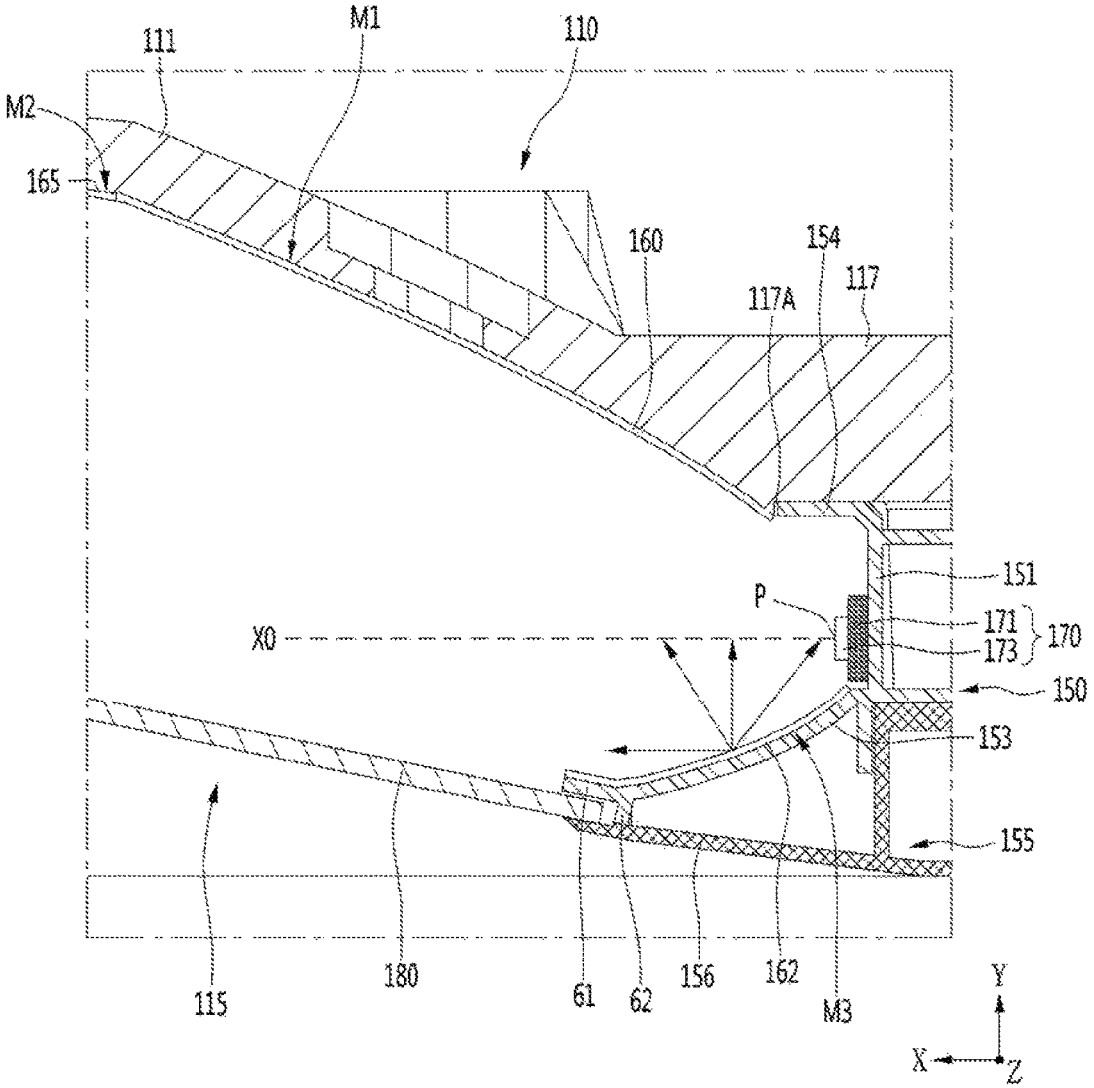

【Figure 11】
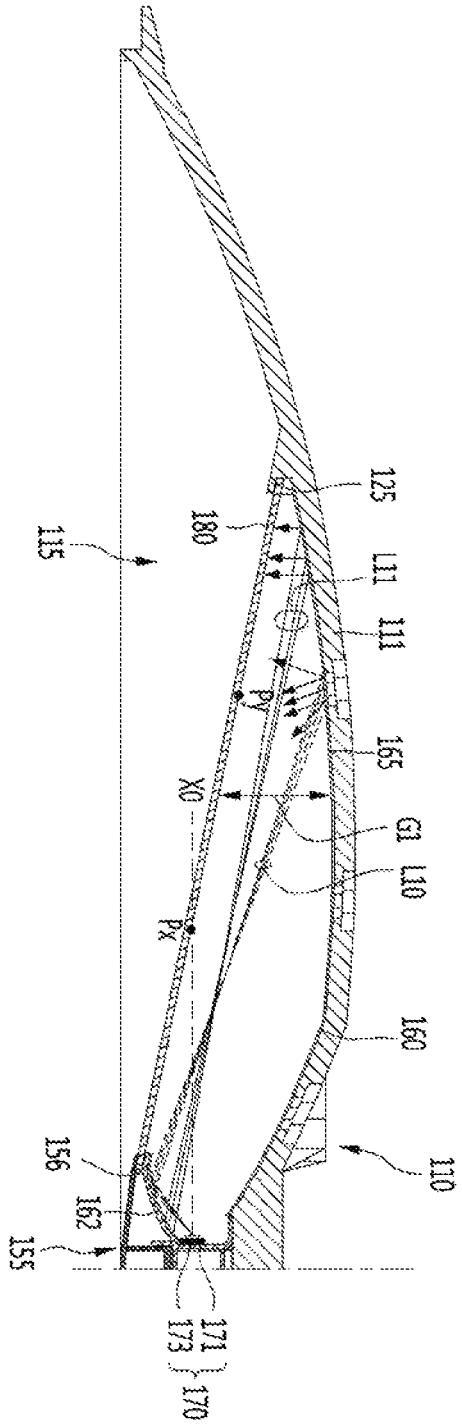

【Figure 12】
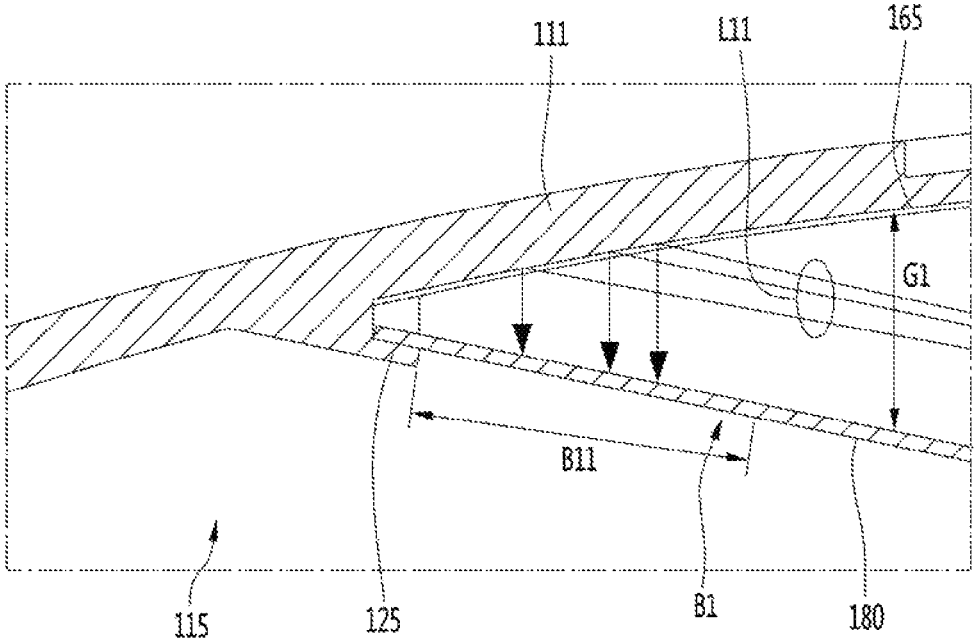

【Figure 13】
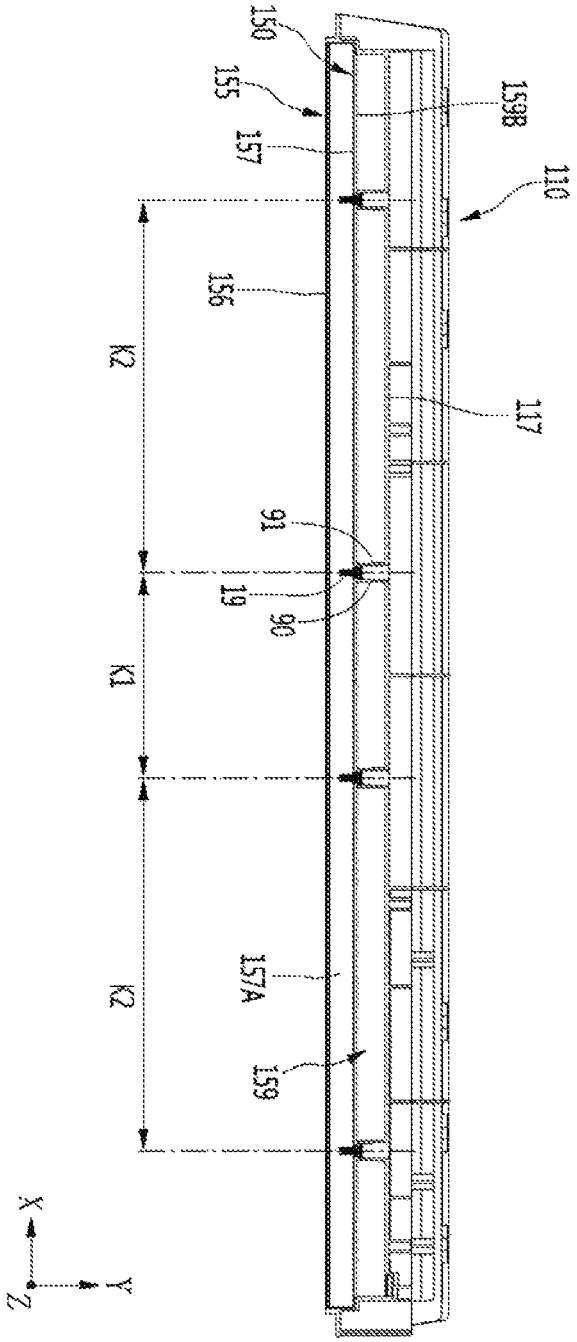

【Figure 14】
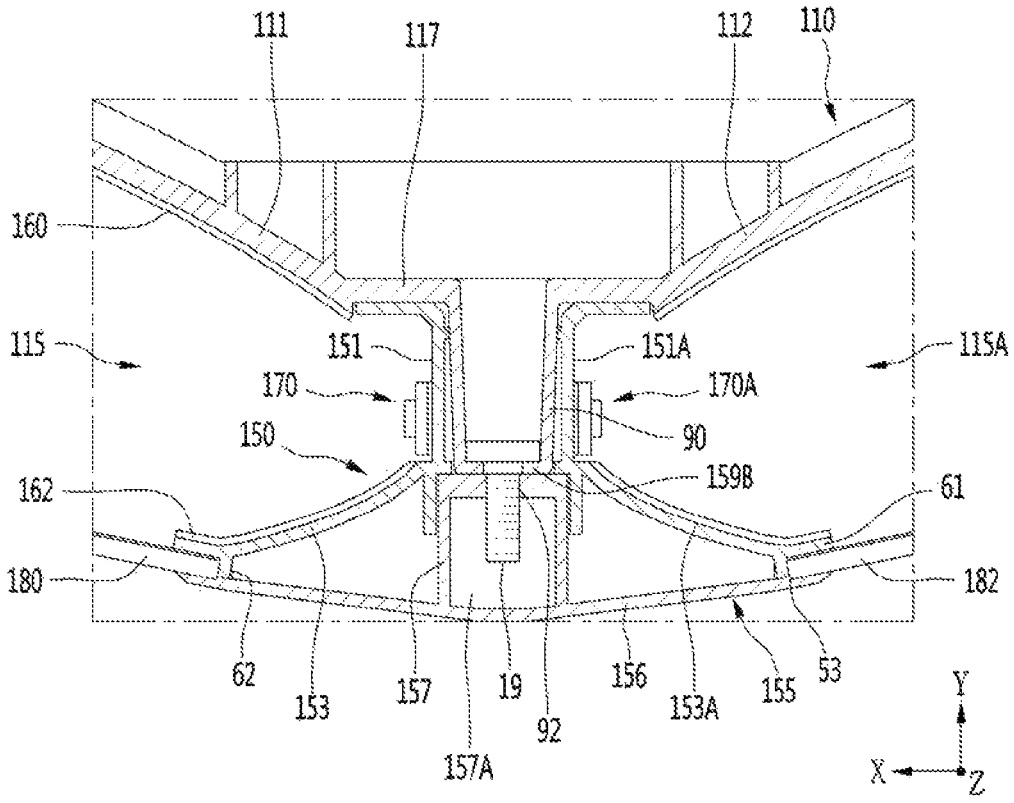
【Figure 15】
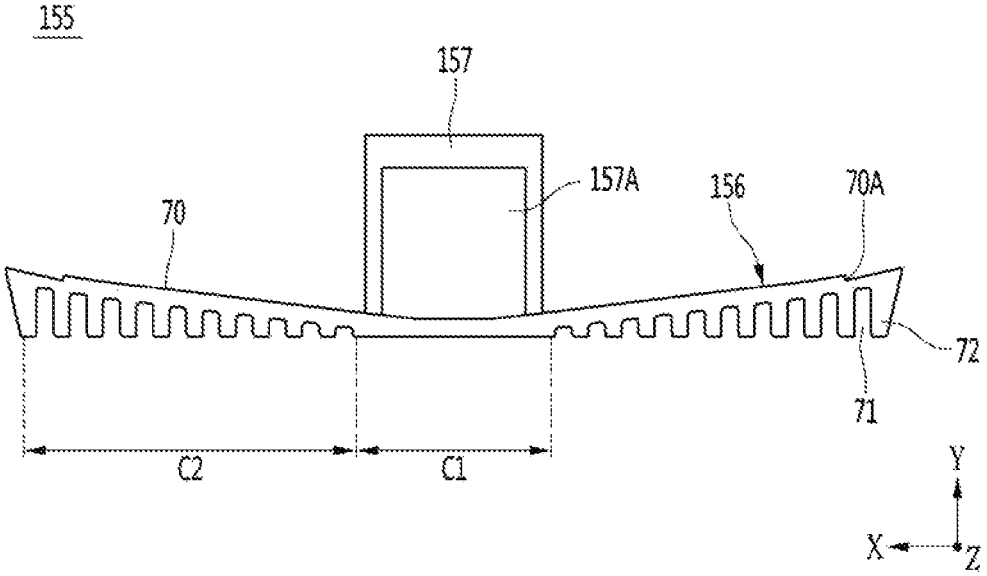

【Figure 16】
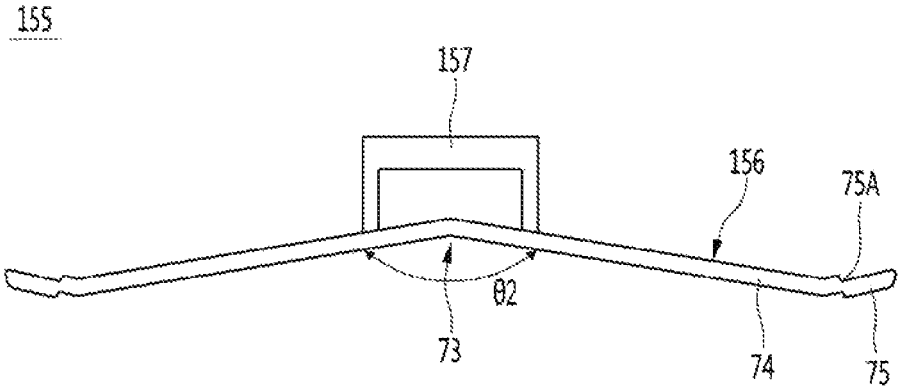
【Figure 17】
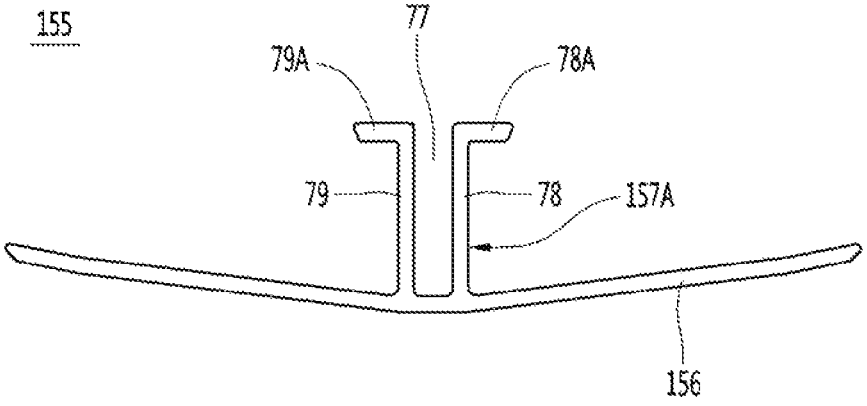

【Figure 18】
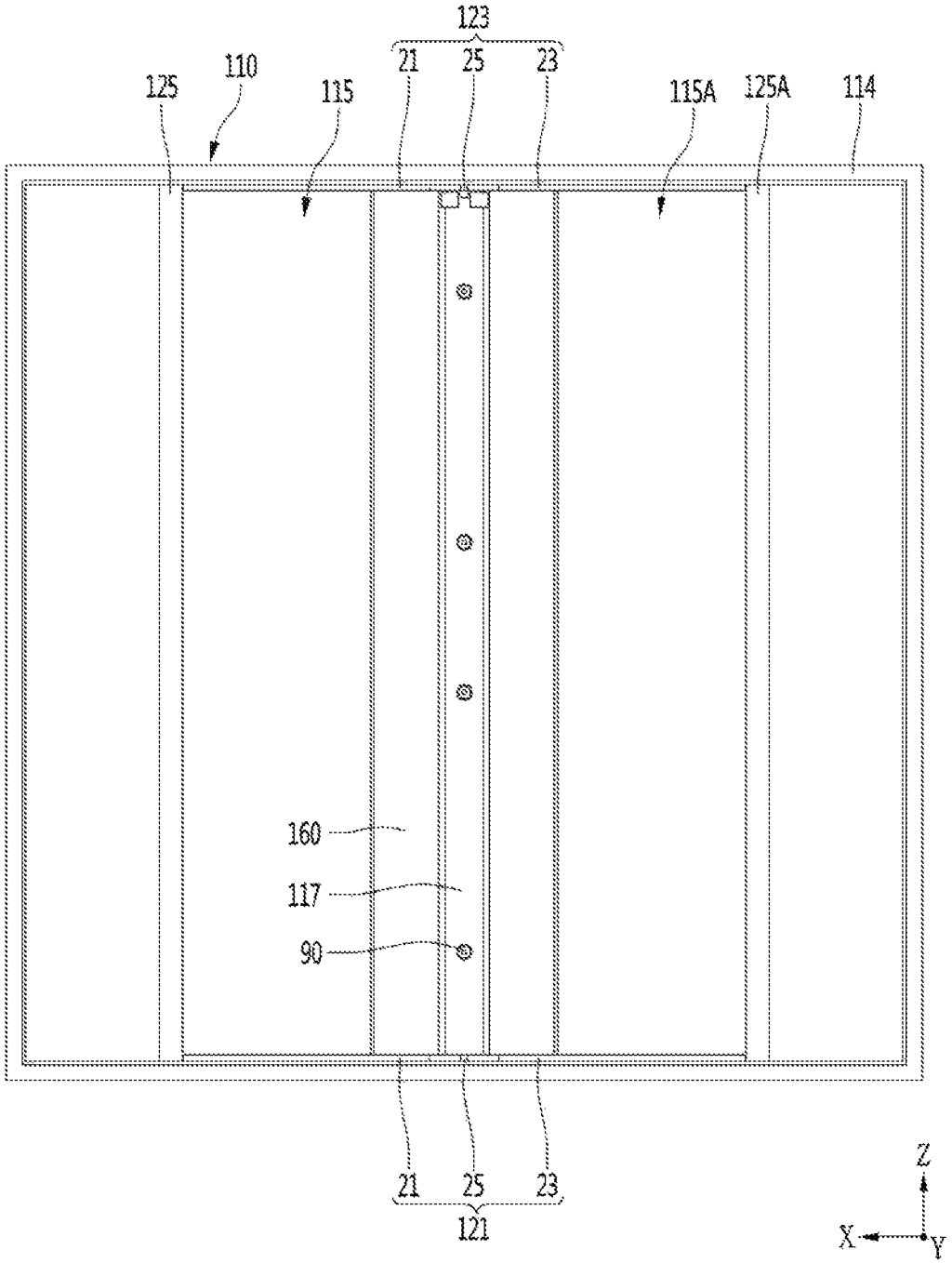

【Figure 19】
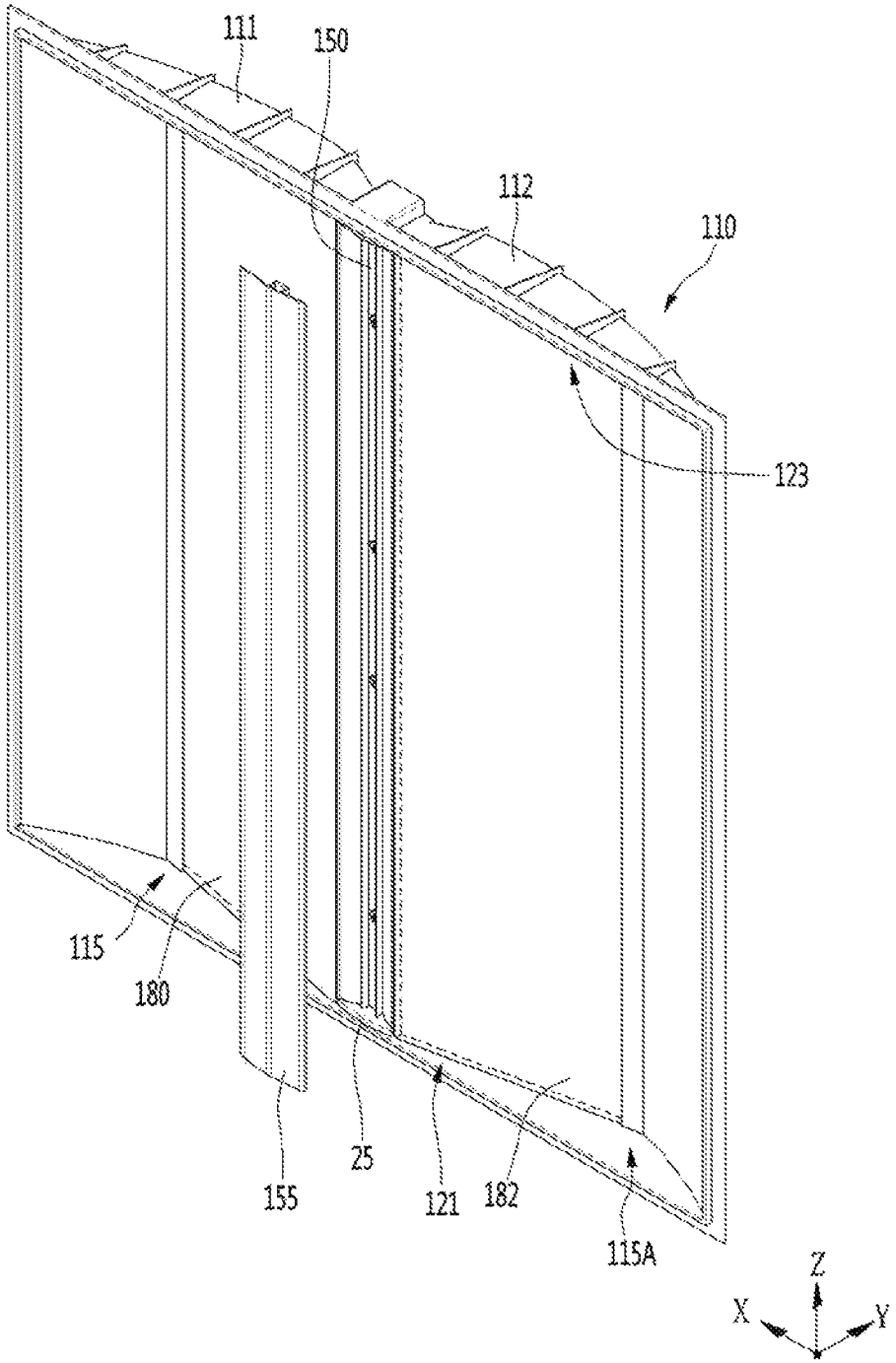

【Figure 20】
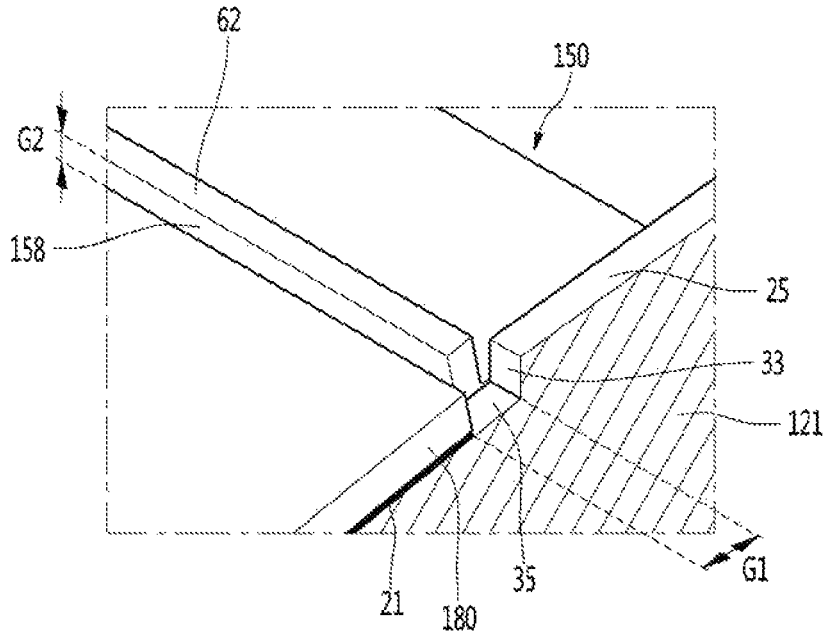
【Figure 21】
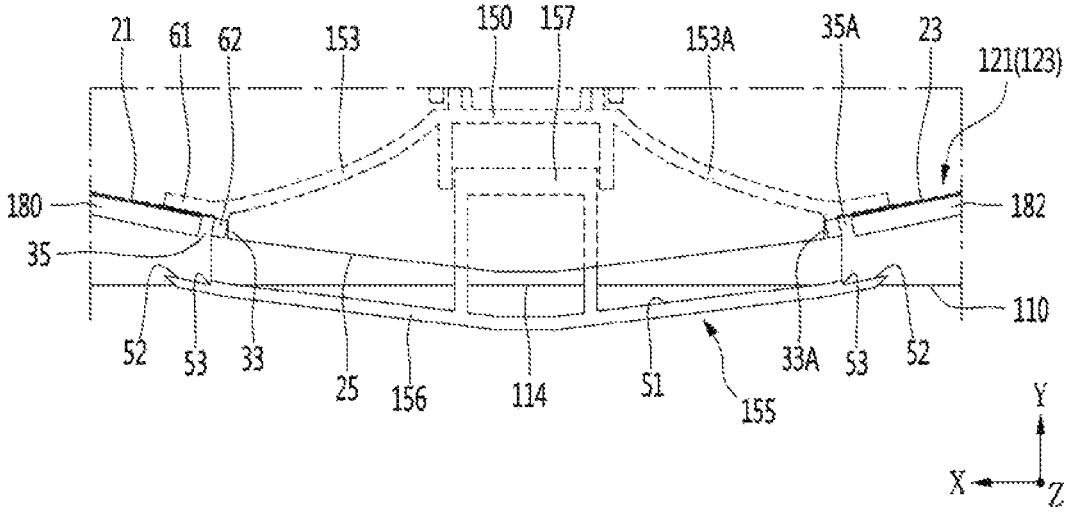

【Figure 22】
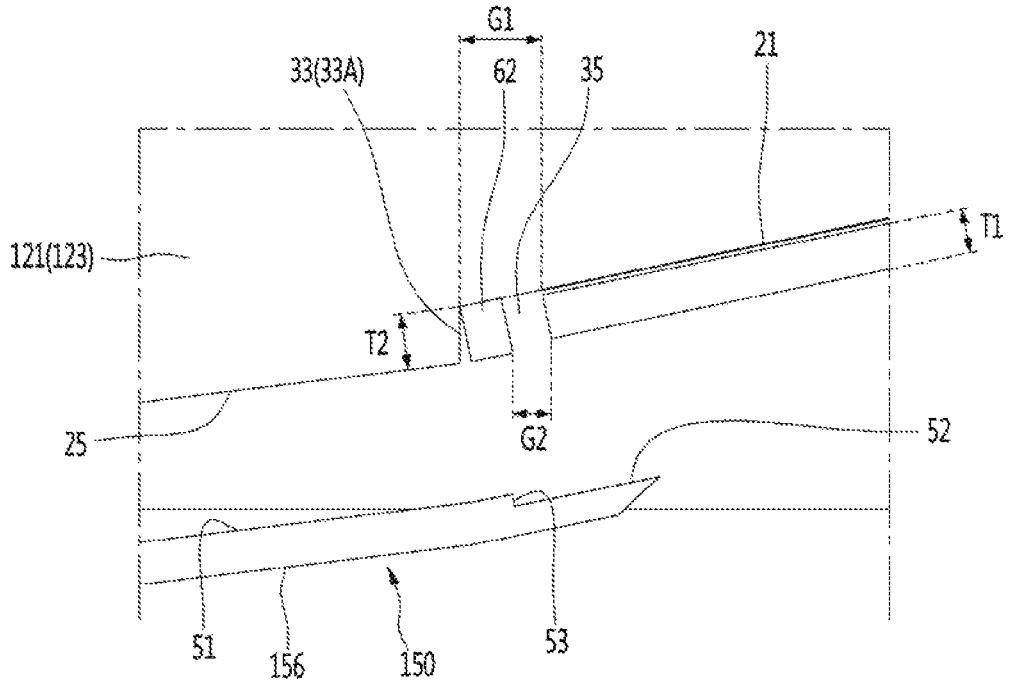
【Figure 23】
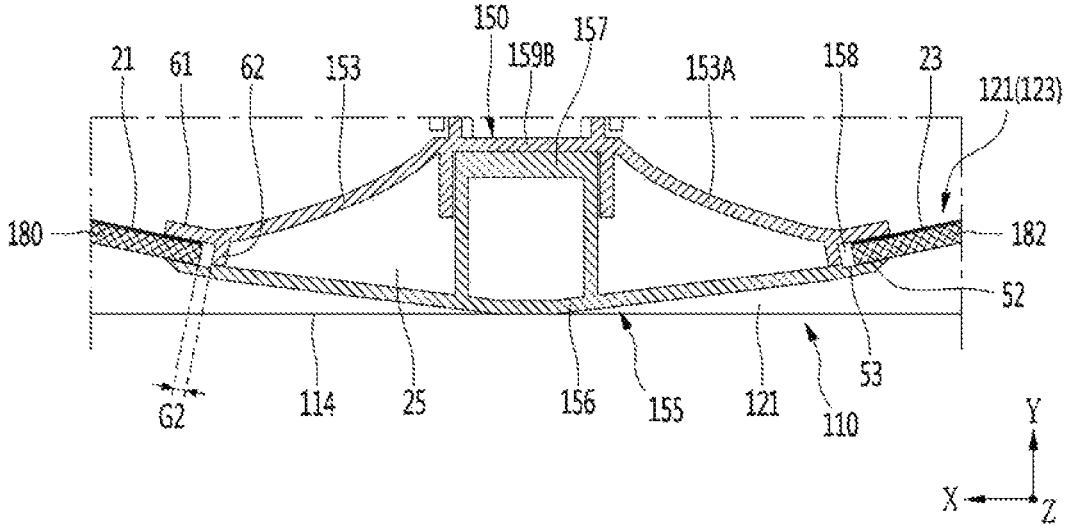

【Figure 24】
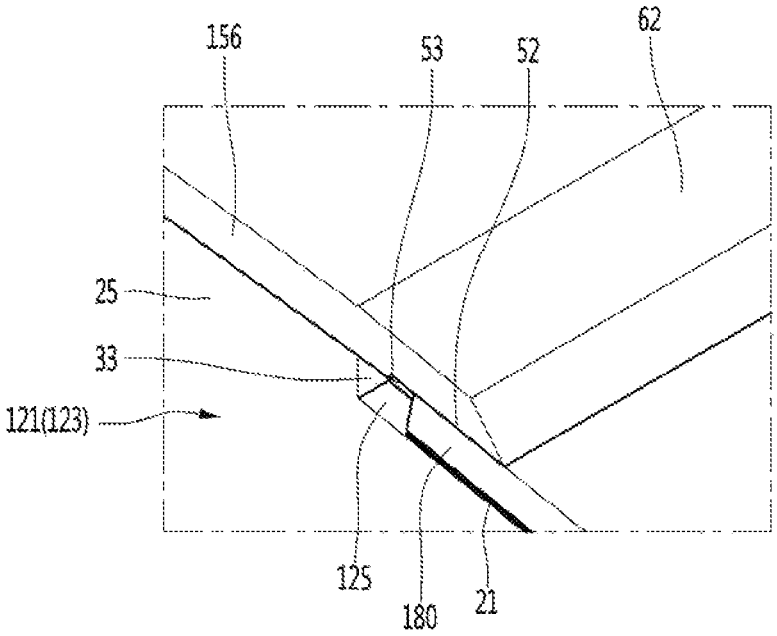
【Figure 25】
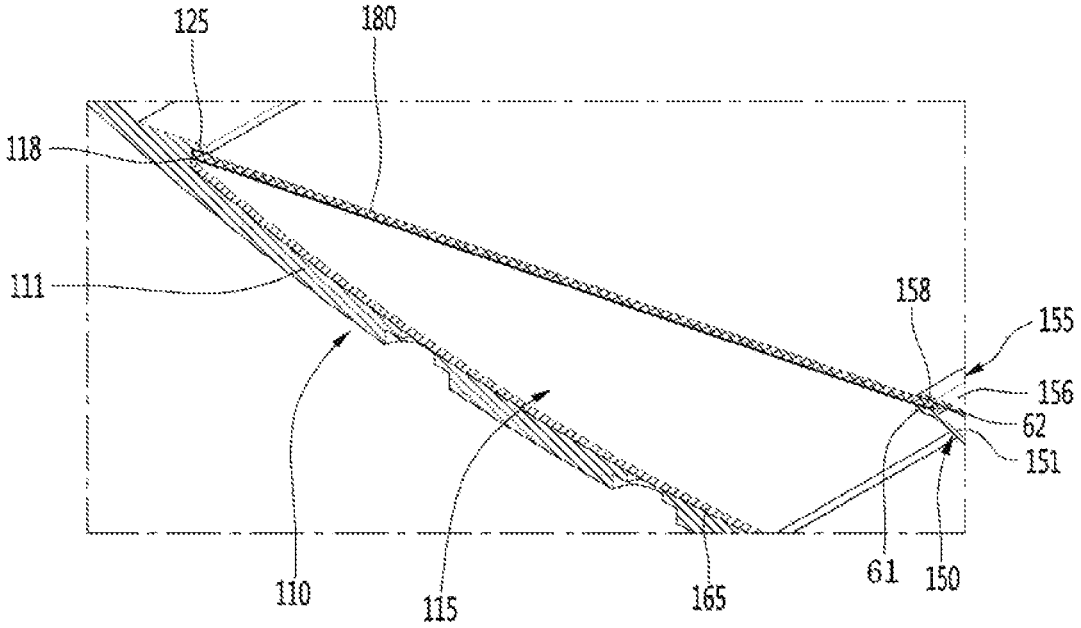

【Figure 26】
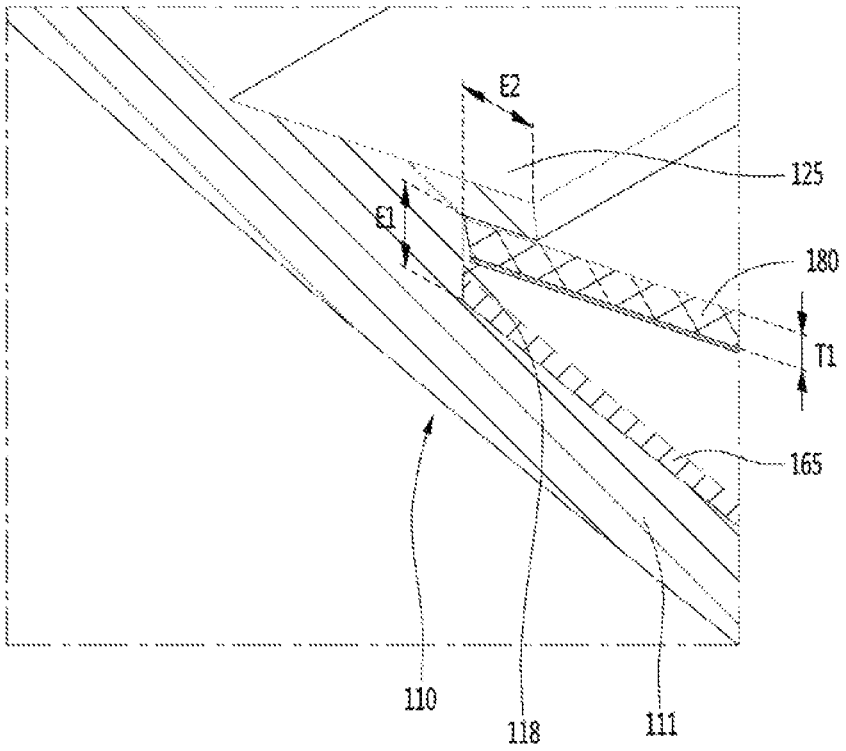
【Figure 27】
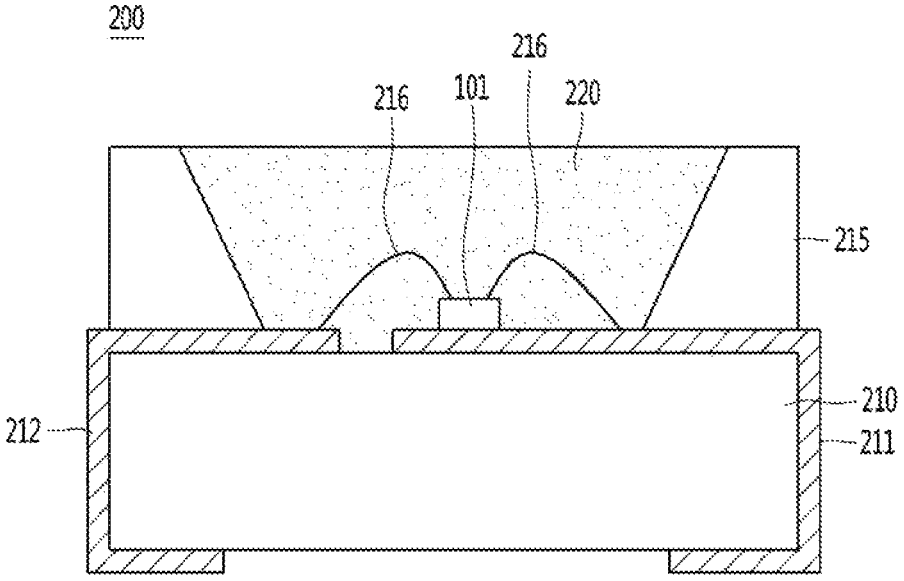

LIGHTING DEVICE

Cross Reference to Related Applications

This application is the National Phase of PCT International Application No. PCT/KR2016/010571, filed on Sep. 22, 2016, which claims priority under 35 U.S.C. 119(a) to Patent Application Nos. 10-2015-0136317, 10-2015-0136321, 10-2015-0136323 and 10-2015-0136324 filed in the Republic of Korea on Sep. 25, 2015, all of which are hereby expressly incorporated by reference into the present application.

TECHNICAL FIELD

An embodiment relates to a lighting device.

BACKGROUND ART

In general, a lighting device using a LED generates a high heat when the lighting device is turned on. This heat results in lowering a life of a lamp and various components supporting the same.

When the lighting device using the LED is used, a hot spot may occur. There is a need for a lighting structure to reduce such a hot spot and to prevent glare.

DISCLOSURE

Technical Problem

An embodiment provides a lighting device for a flat panel.

An embodiment provides a lighting device having a light emitting diode (LED).

An embodiment provides a lighting device for preventing glare.

An embodiment provides a lighting device, which reflects on both side light of a plurality of LEDs and uniformly irradiates the light through a light-transmitting sheet.

An embodiment provides a lighting device in which a non-uniform light distribution is improved by side light emitted from the LED in a specific region of the light-transmitting sheet.

An embodiment provides a lighting device having a front cover configured to cover a heat radiator to which a light-emitting module is coupled in a central axis direction of a housing.

An embodiment provides a lighting device having a front cover configured to support a lower end portion of the light-transmitting sheet disposed on both sides of a center of the housing.

An embodiment provides a lighting device having a latching jaw, which faces one side surface of the light-transmitting sheet on both sidewalls of an inner side of the housing and is disposed on an edge of the light-transmitting sheet.

An embodiment provides a lighting device having a structure in which the light-transmitting sheet can be coupled to a recess of the housing in a sliding manner.

Technical Solution

According to an embodiment, a lighting device includes: a housing having a first back cover and a second back cover on both sides in a first axial direction; a first recess in which a lower portion of the first back cover is opened; a second recess in which a lower portion of the second back cover is opened; a heat radiator disposed between the first and second recesses in a second axial direction perpendicular to the first axial direction at a lower portion of the housing; a first light-emitting module having a plurality of light emitting diodes (LEDs) in a first region of the heat radiator corresponding to the first recess; a second light-emitting module having a plurality of LEDs in a second region of the heat radiator corresponding to the second recess; a first light-transmitting sheet disposed at the first recess so as to be inclined with respect to the first axial direction and configured to diffuse light emitted from the first light-emitting module; a second light-transmitting sheet disposed at the second recess so as to be inclined with respect to the first axial direction and configured to diffuse light emitted from the second light-emitting module; and a front cover configured to support a lower portion of the heat radiator and lower end portions of the first and second light-transmitting sheets, wherein the front cover includes a fixing frame protruding to a direction of the heat radiator at the lower portion of the heat radiator, and a cover plate extending to a direction of the lower end portions of the first and second light-transmitting sheets from the fixing frame.

According to an embodiment, a lighting device includes: a housing having first and second back covers; first and second recesses disposed on both sides of the housing in a first axial direction and configured to have a parabolic shape in which a lower portion of the first and second back covers is opened; a heat radiator disposed between the first and second recesses in a second axial direction; first and second light-emitting modules disposed on opposite sides of the heat radiator and configured to have a plurality of light emitting diodes (LEDs); a first light-transmitting sheet disposed in the first recess of the housing in a diagonal shape and configured to diffuse light emitted from the first light-emitting module; a second light-transmitting sheet disposed in the second recess of the housing in a diagonal shape and configured to diffuse light emitted from the second light-emitting module; a first reflective sheet attached to a surface of a region adjacent to the LED in inner surfaces of the first and second recesses and configured to reflect first side light emitted from the plurality of LEDs; and a second reflective sheet attached to a surface between the first reflective sheet and upper end portions of the first and second light-transmitting sheets in the inner surfaces of the first and second recesses, wherein the heat radiator includes first and second reflective portions extending to lower end portions of the first and second light-transmitting sheets, and comprising a third reflective sheet having a plurality of reflective surfaces having different radii of curvature on the first and second reflective portions, wherein the third reflective sheet includes an irregular reflective sheet.

According to an embodiment, a lighting device includes: a housing having first and second back covers; first and second recesses disposed on both sides of the housing in a first axial direction and in which a lower portion of the first and second back covers is opened; a heat radiator disposed between the first and second recesses in a second axial direction; first and second light-emitting modules disposed on opposite sides of the heat radiator and configured to have a plurality of light emitting diodes (LEDs); a first light-transmitting sheet disposed in the first recess of the housing in a diagonal shape and configured to diffuse light emitted from the first light-emitting module; a second light-transmitting sheet disposed in the second recess of the housing in a diagonal shape and configured to diffuse light emitted from the second light-emitting module; and a front cover coupled under the heat radiator and configured to support under lower end portions of the first and second light-transmitting sheets, wherein the front cover includes a fixing frame protruding in a direction of the heat radiator, and a cover plate extending in a direction of the lower end portions of the first and second light-transmitting sheets below the fixing frame.

According to an embodiment, a lighting device includes: a housing having first and second back covers; first and second recesses disposed on both sides of the housing in a first axial direction and in which a lower portion of the first and second back covers is opened; a heat radiator disposed between the first and second recesses in a second axial direction; first and second light-emitting modules disposed on opposite sides of the heat radiator and having a light emitting diode (LED); a first light-transmitting sheet disposed in the first recess of the housing in a diagonal shape and configured to diffuse light emitted from the first light-emitting module; a second light-transmitting sheet disposed in the second recess of the housing in a diagonal shape and configured to diffuse light emitted from the second light-emitting module; and a front cover coupled under the heat radiator and configured to support under lower end portions of the first and second light-transmitting sheets, wherein the housing includes latching jaws disposed on both sidewalls of the first and second recesses, wherein each of the latching jaws includes a first supporting portion disposed on both sides in a second axial direction of the first light-transmitting sheet, a second supporting portion disposed on both sides in a second axial direction of the second light-transmitting sheet, and a light leakage-preventing portion protruding from the first and second supporting portions in a direction of a lower surface of the housing and facing one side of the first and second light-transmitting sheets.

According to an embodiment, a lighting device includes: a housing having first and second back covers; first and second recesses disposed on both sides of the housing in a first axial direction and in which a lower portion of the first and second back covers are opened; a heat radiator disposed between the first and second recesses in a second axial direction; first and second light-emitting modules disposed on opposite sides of the heat radiator and configured to have a plurality of light emitting diodes (LEDs); a first light-transmitting sheet disposed in the first recess of the housing in a diagonal shape and configured to diffuse light emitted from the first light-emitting module; a second light-transmitting sheet disposed in the second recess of the housing in a diagonal shape and configured to diffuse light emitted from the second light-emitting module; and a front cover coupled under the heat radiator and configured to support under lower end portions of the first and second light-transmitting sheets, wherein the housing includes latching jaws disposed on both sidewalls of the first and second recesses, and first and second latching jaws disposed long in the second axial direction on upper surfaces of the first and second recesses, wherein the first light-transmitting sheet is disposed under a latching jaw of the first recess and on the first latching protrusion, and the second light-transmitting sheet is disposed under a latching jaw of the second recess and on the second latching protrusion.

Advantageous Effects

An embodiment may provide a new lighting device for a flat panel.

An embodiment may improve uniformity and glare of light in a lighting device.

An embodiment may reflect side light of a plurality of light emitting diodes (LEDs) to improve glare in a light-transmitting sheet.

An embodiment may improve a light distribution in a narrow gap between an upper surface of a recess in a back cover and an oblique light-transmitting sheet.

In an embodiment, a front cover is detachably attached to a lower center of a housing to cover a lower end portion of a heat radiator and both side light-transmitting sheets, and thus an appearance design can be changed into various forms.

An embodiment can improve leakage of light leaking through a gap between an inner wall of a front cover and the front cover at the lower center of the housing.

In an embodiment, a holder does not need to be provided by combining a light-transmitting sheet in a sliding form in the recess of the housing and an assembling process can be reduced.

In an embodiment, reliability of a lighting device can be improved.

DESCRIPTION OF DRAWINGS

FIG. 1 is an exploded perspective view of a lighting device according to an embodiment.

FIG. 2 is an assembled perspective view of a lighting device of FIG. 1.

FIG. 3 is a side cross-sectional view of a lighting device of FIG. 1.

FIG. 4 is a partially enlarged view of a lighting device of FIG. 2.

FIG. 5 is an exploded perspective view of a heat radiator and a front cover of FIG. 1.

FIG. 6 is a partially enlarged view of a heat radiator and a front cover of FIG. 1.

FIG. 7 is an assembled perspective view of a heat radiator and a front cover of FIG. 5.

FIG. 8 is an enlarged view of a first back cover of a lighting device of FIG. 3 illustrating a comparison of each reflection region in a first recess.

FIG. 9 is an enlarged view of a first back cover of a lighting device of FIG. 3.

FIG. 10 is a view illustrating first and third reflective sheets on a first back cover of FIG. 9.

FIG. 11 is a view illustrating an optical path by a third reflective sheet in a first back cover of a lighting device of FIG. 9.

FIG. 12 is a partially enlarged view of FIG. 11 for explaining a problem caused by a gap between a light-transmitting sheet and a recess top surface.

FIG. 13 is a sectional view taken along line A-A of a lighting device of FIG. 2.

FIG. 14 is a side cross-sectional view illustrating a combination of a heat radiator and a front cover in a housing according to an embodiment.

FIG. 15 to 17 are views illustrating another example of a front cover according to an embodiment.

FIG. 18 is a view illustrating a latching jaw disposed on an inner sidewall of a housing of FIG. 1.

FIG. 19 is a perspective view of a housing of FIG. 1 before a front cover is coupled.

FIG. 20 is a view illustrating a latching jaw and a light-transmitting sheet in an inner sidewall of a housing in FIG. 19.

FIG. 21 is a view illustrating a front cover and a light-transmitting sheet on a latching jaw of a housing in FIG. 19.

FIG. 22 is a partially enlarged view of FIG. 21.

FIG. 23 is a view illustrating an example in which a light-transmitting sheet and a front cover are coupled on a latching jaw in FIG. 19.

FIG. 24 is a view illustrating a latching jaw of a housing, a light-transmitting sheet and a front cover in FIG. 23.

FIG. 25 is a view illustrating an example in which both end portions of a light-transmitting sheet are combined in FIG. 19.

FIG. 26 is a partially enlarged view of FIG. 25.

FIG. 27 is a side cross-sectional view illustrating a light emitting diode (LED) according to an embodiment.

MODES OF THE INVENTION

Hereinafter, preferred embodiments of a lighting device according to an embodiment will be described with reference to the accompanying drawings. Terms described below are terms defined in consideration of functions in the present embodiments and may vary depending on the intention of a user or operator or a practice. Therefore, such terms should be defined on the basis of the entire contents disclosed herein. In addition, the following embodiments are not intended to limit the scope of the present invention, but are merely presented as examples, and there may be various embodiments implemented through the technical idea.

Hereinafter, a preferred embodiment of the present invention will be described in more detail with reference to the accompanying drawings. Meanwhile, term "lighting module or lighting device" as used herein refers to a lighting device used for indoors or outdoors, and it is clearly put in advance that it is used as a collective term of similar apparatuses such as flat panel lamps, light fixtures, street lights, various lamps, electronic bulletin boards, headlights, etc.

FIG. 1 is an exploded perspective view of a lighting device according to an embodiment. FIG. 2 is an assembled perspective view of a lighting device of FIG. 1, FIG. 3 is a side cross-sectional view of a lighting device of FIG. 1, FIG. 4 is a partially enlarged view of a lighting device of FIG. 2, FIG. 5 is an exploded perspective view of a heat radiator and a front cover of FIG. 1, FIG. 6 is a partially enlarged view of a heat radiator and a front cover of FIG. 1, and FIG. 7 is an assembled perspective view of a heat radiator and a front cover of FIG. 5.

Referring to FIGS. 1 to 7, a lighting device 100 includes a housing 110 having back covers 111 and 112 having recesses 115 and 115A whose lower portion is opened, a heat radiator 150 disposed at a lower portion of a center of the back covers 111 and 112, light-emitting modules 170 and 170A disposed on the heat radiator 150, and light-transmitting sheets 180 and 182 disposed on the recesses 115 and 115A of the back covers 111 and 112.

Referring to FIGS. 1 to 3, the housing 110 includes back covers 111 and 112 having recesses 115 and 115A whose lower portion is convexly upwardly recessed. The back covers 111 and 112 may include the first and second back covers 111 and 112 symmetrical with respect to a center line in a second Z-axis direction. The recesses 115 and 115A may have a symmetrical shape to each other with respect to a center line in a second Z-axis direction at a lower portion of a center side of the housing 110. The second Z-axis direction may be a central axis direction. The back covers 111 and 112 and the recesses 115 and 115A may be disposed in a shape symmetrical in a first X-axis direction with respect to a center line in a second axis direction. The first X-axis direction may be perpendicular to the second Z-axis direction on the same horizontal plane. A direction orthogonal to the first X-axis direction and the second Z-axis direction may be a height direction or a thickness direction and a third Y-axis direction.

The recesses 115 and 115A may include first and second recesses 115 and 115A disposed on both sides in the first axis direction with respect to the second Z-axis direction of a center side of the housing 110. A lower portion of the first back cover 111 may be opened at the first recess 115, and a lower portion of the second back cover 112 may be opened at the second recess 115A. The first back cover 111 may have the first recess 115 at the lower portion thereof, and the second back cover 112 may have the second recess 115A at the lower portion thereof. The first and second recesses 115 and 115A are convex upward on an X-Z plane, and the first and second back covers 111 and 112 may be disposed on an outer periphery of the first and second recesses 115 and 115A.

Inner surfaces of the first and second back covers 111 and 112 may include recesses 115 and 115A having a parabola shape or an ellipse shape. The outer shape of the first and second back covers 111 and 112 may include a plurality of parabolic shapes, a plurality of ellipse shapes, a hyperbola, or a pair of curved surfaces, and is not limited thereto. A heat-dissipating member, for example, the heat radiator 150 may be disposed in a region between the first and second recesses 115 and 115A. The first and second back covers 111 and 112 may be in a line-symmetrical shape with respect to the second Z-axis direction of a center side. A power supply device (not shown) may be provided on the back covers 111 and 112, and is not limited thereto.

The housing 110 may have both sidewalls of the recesses 115 and 115A, and the both sidewalls may be disposed facing each other with respect to the second Z-axis direction. A reflective material or a reflective sheet (not shown) may be further disposed on inner surfaces of the both sidewalls of the recesses 115 and 115A for reflection of light, but is not limited thereto. A depth of the recesses 115 and 115A may be formed deeper toward a center region of the back covers 111 and 112. The first and second recesses 115 and 115A may be different lighting regions.

Referring to FIGS. 2 and 3, when viewed in the X-Z plane, a length X1 in the first X-axis direction and a length Z1 in the second Z-axis direction may be the same or different from each other in the housing 110. The length X1 may have a relationship of $X1 \geq Z1$ or may have a relationship of $X1 \leq Z1$. When the length X1 differs from the length Z1, the difference may be 5 times or less.

A thickness Y1 or a height of the housing 110 may be 1/10 or less of a length in the first X-axis direction and/or the second Z-axis direction, and for example, may range from 49 to 59 mm. The thickness Y1 of the housing 110 may be disposed to be 1/10 or less of a length in the first X-axis direction and/or the second Z-axis direction so that a lighting device having a slim thickness can be provided. The first X-axis direction is a transverse direction or a width direction of the housing 110 and the second Z-axis direction is an axial direction orthogonal to the first X-axis direction. The third Y-axis direction may be a height or a thickness direction. Here, a size X1×Z1 of the lighting device is 550 to 600 mm×550 to 600 mm, and a thickness or height Y1 may be in a range of 50 to 52 mm, and is not limited thereto.

A receiving protrusion 113 may be disposed at both edges 114 of the housing 110 and the receiving protrusion 113 may be coupled to another structure such as a ceiling. The receiving protrusion 113 may have a stepped structure or a latching jaw structure with respect to the edge 114, or may have a protruding structure that further protrudes in an outward direction. As shown in FIG. 3, a plurality of fastening holes 105 may be disposed in the first and second back covers 111 and 112 of the housing 110 to be fastened to other structure.

As shown in FIGS. 1 and 3, a connection portion 117 may be disposed in a region between the first and second back covers 111 and 112. The connection portion 117 may be disposed in a region between an outer curved surface of the first back cover 111 and an outer curved surface of the second back cover 112. An upper surface of the connection portion 117 may be disposed lower than outer surfaces of the first and second back covers 111 and 112. The connection portion 117 may be formed in the second Z-axis direction or a central axis direction of the housing 110. One or a plurality of fastening protrusions 90 may protrude from the connection portion 117 and the fastening protrusions 90 may be a component such as a boss or a fastening part such as a screw or a rivet. The connection portion 117 may be provided with a fastening hole into which a fastening part such as a screw is inserted, but is not limited thereto. Since the fastening protrusions 90 are coupled through the heat radiator 150, a flow of the heat radiator 150 may be suppressed. The upper surface of the connection portion 117 may be a plane, for example, a horizontal plane. When the upper surface of the connection portion 117 is a plane, a contact area with other structure may be increased or a structure such as a power supply device may be easily adhered or fixed. A thickness of the connection portion 117 may be formed greater than that of the first and second back covers 111 and 112. The thickness of the first and second back covers 111 and 112 is a distance between an upper surface of the recesses 115 and 115A and an outer curved surface of the back covers 111 and 112. The connection portion 117 may support the heat radiator 150 and may be coupled to a power supply device.

The housing 110, for example, the back covers 111 and 112 may include a plastic material, and for example, may include at least one of polycarbonate (PC), polyethylene terephthalate glycol (PETG), polyethylene (PE), polystyrene paper (PSP), polypropylene (PP), and polyvinyl chloride (PVC).

The back covers 111 and 112 may have a material having higher reflectance than transmittance and may be a material having reflectance of 70% or more, for example, 80% or more. Light incident on surfaces of the back covers 111 and 112 may be reflected by increasing the reflectance of the back covers 111 and 112. The back covers 111 and 112 may be a material having light absorption rate of 20% or less, for example, 15% or less, but is not limited thereto. The back covers 111 and 112 may be added with a metal oxide in a resin material such as silicone or epoxy. The back covers 111 and 112 are formed of a white resin material, thereby improving a reflection efficiency of light.

The heat radiator 150 may be disposed in the second Z-axis direction under the third Y-axis direction of the housing 110. The heat radiator 150 may be disposed on the opposite region of the connection portion 117 of the housing 110. The heat radiator 150 may be disposed in the Z-axis direction in a region between the first and second recesses 115 and 115A. The heat radiator 150 may be disposed in a region overlapping with the connection portion 117 of the housing 110 in the Y-axis direction. The heat radiator 115 may be disposed above a horizontal plane of a lower surface of the housing 110 or may be disposed in a non-protruding structure. The heat radiator 150 may be in a bar shape.

The heat radiator 150 may be made of a metal material, and for example, may include at least one of metals such as aluminum, copper, nickel, and silver, and is not limited thereto. The heat radiator 150 may include a carbon material, and is not limited thereto.

Referring to FIGS. 3 to 6, the heat radiator 150 includes heat dissipation parts 151 and 151A disposed on opposite sides of each other with respect to the third Y-axis direction and reflectors 153 and 153A protruding in opposite directions to each other at a lower portion of the heat dissipation parts 151 and 151A.

The heat dissipation parts 151 and 151A may have a vertical surface in the recesses 115 and 115A direction, and the vertical surface may include a flat surface. The vertical surface may correspond to each of the light-transmitting sheets 180 and 182. The heat dissipation parts 151 and 151A may include a first heat dissipation part 151 disposed on an inner side of the first recess 115 and a second heat dissipation part 151A disposed on an inner side of the second recess 115A. The first heat dissipation part 151 and the second heat dissipation part 151A may be disposed in opposite directions to each other with respect to the heat radiator 150. The first heat dissipation part 151 may have a vertical surface in the Y-axis direction in the inner side of the first recess 115 and the second heat dissipation part 151A may have a vertical surface in the Y-axis direction in the inner side of the second recess 115A. The vertical surfaces of the first and second heat dissipation parts 151 and 151A may be flat surfaces and disposed at a right angle to the first X-axis direction in the third Y-axis direction or a thickness direction.

The heat radiator 150 may have a heat-dissipating hole 159 and the heat-dissipating hole 159 may be disposed in the second Z-axis direction. The heat-dissipating hole 159 may be disposed in the same axial direction as an axial direction in which a light emitting diode (LED) 173 is disposed. A side cross-section of the heat-dissipating hole 159 may be in a polygonal or circular shape, but is not limited thereto. The heat-dissipating hole 159 may be provided with an open structure at both end portions as shown in FIG. 6. Such a heat-dissipating hole 159 may provide a vertical or horizontal direction path through which heat conducted from the first and second heat dissipation parts 151 and 151A may be transferred. The heat radiator 150 may include an upper frame 159A disposed above the heat-dissipating hole 159 and a lower frame 159B disposed below the heat-dissipating hole 159. The upper frame 159A and the lower frame 159B may be bent or coupled from the first and second heat dissipation parts 151 and 151A.

The heat-dissipating hole 159 may be disposed in a region between the first and second heat dissipation parts 151 and 151A and the upper and lower frames 159A and 159B. A plurality of insertion holes 91 penetrate in the Y-axis direction in the upper frame 159A and the lower frame 159B, and the fastening protrusion 90 in FIG. 1 of the housing 110 may be inserted thereto. A fastening hole 92 may be disposed along a fixing frame 157 as shown in FIG. 6 in a front cover 155 corresponding to the insertion hole 91. Accordingly, a fastening part 19 on the housing 110 of FIG. 1 may be used to fasten to the fastening hole 92 of the front cover 155 via the fastening protrusion 90.

The light-emitting modules 170 and 170A may be disposed on the heat radiator 150 in the Z-axis direction. The light-emitting modules 170 and 170A may be coupled to opposite sides of the heat radiator 150 in the X-axis direction. The light-emitting modules 170 and 170A may have a long length in a longitudinal direction of the heat radiator 150. The light-emitting modules 170 and 170A emit light in the different directions of recesses 115 and 115A.

The light-emitting modules 170 and 170A may be disposed on vertical surfaces of the heat dissipation parts 151 and 151A of the heat radiator 150. The light-emitting modules 170 and 170A include a plurality of light-emitting modules and for example, may include first and second light-emitting modules 170 and 170A. The first light-emitting module 170 is disposed in a first region of the heat radiator 150 corresponding to the first recess 115, and the second light-emitting module 170A may be disposed in a second region of the heat radiator 150 corresponding to the second recess 115A. The first light-emitting module 170 emits light through the first recess 115 and the second light-emitting module 170A emits light through the second recess 115A. The first light-emitting module 170 may be disposed in the first heat dissipation part 151 and the second light-emitting module 170A may be disposed in the second heat dissipation part 151A.

Some light in light emitted from the first and second light-emitting modules 170 and 170A may be reflected and some light may be irradiated to the light-transmitting sheets 180 and 182. When light emitted in a horizontal direction from the first and second light-emitting modules 170 and 170A is irradiated to the light-transmitting sheets 180 and 182, this may be defined as direct lighting. When the reflected light is irradiated to the light-transmitting sheets 180 and 182, it can be defined as indirect lighting. The light-transmitting sheets 180 and 182 may be disposed in one or more than one. The light-transmitting sheets 180 and 182 may include a first light-transmitting sheet 180 disposed on the first recess 115 and a second light-transmitting sheet 182 disposed on the second recess 115A.

As shown in FIG. 4, the reflectors 153 and 153A may have a predetermined curvature from the heat dissipation parts 151 and 151A on opposite sides respectively, and extend in opposite directions to each other. The reflectors 153 and 153A may be disposed at a lower portion of the heat dissipation parts 151 and 151A. The reflectors 153 and 153A may extend integrally from the heat dissipation parts 151 and 151A. The reflectors 153 and 153A may include a plurality of reflection regions having surfaces having different radii of curvature and reflecting incident light. The reflectors 153 and 153A include first and second reflectors 153 and 153A extending from each of the heat dissipation parts 151 and 151A.

The front cover 155 is disposed at a lower portion of the heat radiator 150. The front cover 155 may be coupled to the lower portion of the heat radiator 150. The front cover 155 may overlap the heat radiator 150 in the Y-axis direction and may be disposed along the heat radiator 150 in the Z-axis direction. The front cover 155 may prevent a lower region of the heat radiator 150 from being exposed. A width of the front cover 155 in the X-axis direction may be larger than a gap between the first and second light-emitting modules 170 and 170A. A width of the front cover 155 in the horizontal direction may be wider than that of the connection portion 117 in the X-axis direction. Such a front cover 155 may cover a lower region between the recesses 115 and 115A.

The first reflector 153 is disposed between the first heat dissipation part 151 and the front cover 155 and the second reflector 153A is disposed between the second heat dissipation part 151A and the front cover 155. The front cover 155 may be disposed at a lower portion of the first reflector 153 and the second reflector 153A to prevent lower surfaces of the first and second reflectors 153 and 153A from being exposed to an outside. Each edge of the first and second reflectors 153 and 153A may be disposed on a region corresponding to both edges of the front cover 155.

The first and second reflectors 153 and 153A may have a curved shape. Inner surfaces of the first and second reflectors 153 and 153A may have a curved surface. The first reflector 153 may extend from the first heat dissipation part 151 to the outside of a lower end portion of the first light-transmitting sheet 180. The second reflector 153A may extend from the second heat dissipation part 151A to the outside of a lower end portion of the second light-transmitting sheet 182. An inner surface of the first reflector 153 may include a reflection region having different radii of curvature and an inner surface of the second reflector 153A may include a reflection region having different radii of curvature. The inner surfaces of the first and second reflectors 153 and 153A may be disposed in directions of the first and second recesses 115 and 115A.

An upper end portion of the first reflector 153 may be disposed at a lower portion of the first light-emitting module 170 and an upper end portion of the second reflector 153A may be disposed at a lower portion of the second light-emitting module 170A. The first and second reflectors 153 and 153A are adjacent to the lower portions of the first and second light-emitting modules 170 and 170A and reflect side light transferring downward from light emitted from the LED 173. The reflected light may transfer to inner surfaces of the light-transmitting sheets 180 and 182 and the back covers 111 and 112. A third reflective sheet 162 may be disposed on the inner surfaces of the reflectors 153 and 153A, or the inner surfaces may be coated with a reflective material, or a metal surface of the heat radiator 150 may be exposed. The upper end portions of the reflectors 153 and 153A may overlap the LED 173 of the light-emitting modules 170 and 170A in a vertical direction, thereby effectively reflecting incident light.

Referring to FIGS. 4, 6 and 7, the heat radiator 150 may include reflection frames 154 and 154A on an outer side of an upper portion thereof, and the reflection frames 154 and 154A may protrude in an outward direction further than the upper frame 159A. The reflection frames 154 and 154A may be bent in an outward direction from upper portions of the first and second heat dissipation parts 151 and 151A, for example, in the first and second recess directions. The reflection frames 154 and 154A may overlap with the light-emitting modules 170 and 170A in a vertical direction and may reflect light emitted in an upward direction from the LED 173. The reflection frames 154 and 154A may cover upper regions of the first and second light-emitting modules 170 and 170A. The reflection frames 154 and 154A may be in close contact with or bonded to a lower surface of the center side connection portion 117 of the housing 110. A concave groove 117A may be provided on the lower surface of the center side connection portion 117 so that the reflection frames 154 and 154A may be inserted into the groove 117A. An upper surface and outer surface of the reflection frame 115 and 115A may be in contact with the groove 117A.

Referring to FIGS. 4 to 7, the front cover 155 may be disposed under the heat radiator 150. The front cover 155 may include a metal material or a non-metal material, and may be coupled to the heat radiator 150. When the front cover 155 is a metal material, heat conducted from the heat radiator 150 may be dissipated to an outside. When the heat radiator 150 is a non-metallic material, for example, a plastic material, a design of the front cover 155 may be changed variously.

The front cover 155 may include a fixing frame 157 disposed below the lower frame 159B of the heat radiator 150 and a cover plate 156 disposed below the fixing frame 157.

The fixing frame 157 of the front cover 155 may have a plurality of fastening holes 92 and be inserted into a receiving groove 153B of the lower frame 159B of the heat radiator 150, and the fastening member 19 in FIG. 1 fastened via the heat radiator 150 may be fastened to the fastening hole 92. Accordingly, the front cover 155 may be fixed to the heat radiator 150, and the heat radiator 150 may be fixed to the housing 110. The cover plate 156 of the front cover 155 may extend into regions of the first and second recesses 115 and 115A. The cover plate 156 may be formed as a curved surface or an inclined surface on an upper surface or a lower surface thereof. The cover plate 156 may be formed in a symmetrical shape with respect to a center line in the second Z-axis direction.

As shown in FIGS. 4 and 6, the heat radiator 150 may include a light leakage-preventing protrusion 62 protruding from an end portion 61 of the first and second reflectors 153 and 153A in the front cover direction or a downward direction. The end portion 61 of the first and second reflectors 153 and 153A and the cover plate 156 of the front cover 155 are spaced apart from each other, a region between the end portion 61 of the first and second reflectors 153 and 153A and the cover plate 156 may be provided with a latching groove 158, and the lower end portions of the light-transmitting sheets 180 and 182 may be disposed in the latching groove 158, respectively. The light leakage-preventing protrusion 62 may be disposed to face one sides of the light-transmitting sheets 180 and 182, respectively.

As shown in FIGS. 1, 4 and 7, each of the light-emitting modules 170 and 170A includes a circuit board 171 and a plurality of LEDs 173 disposed on the circuit board 171. The circuit board 171 may be upright in the third Y-axis direction and have a long length in the second Z-axis direction. The plurality of LEDs 173 may be disposed in a longitudinal direction of the circuit board 171 or in the second Z-axis direction. The first and second light-emitting modules 170 and 170A may be disposed in opposite directions to each other in a region between the first and second recesses 115 and 115A.

The circuit board 171 may be disposed long on the heat dissipation parts 151 and 151A in a longitudinal direction (Z-axis direction) of the heat radiator 150. The circuit board 171 may be disposed in one or plural on the heat dissipation parts 151 and 151A, and is not limited thereto. The circuit board 171 may be arranged in one or plural on each of the heat dissipation parts 151 and 151A. The circuit board 171 may be fastened with a screw and/or bonded with adhesive on the heat dissipation parts 151 and 151A, and is not limited thereto. The circuit board 171 may include, for example, a printed circuit board (PCB). The PCB includes at least one of a resin material PCB, a metal core PCB (MCPCB), and a flexible PCB (FPCB), and for example, may be provided as a metal core PCB for heat dissipation.

The LED 173 may emit at least one of blue, red, green, white, and UV light as a package in which a light emitting chip is packaged, and for example, white light may be emitted for lighting. The LED 173 may be mounted on the circuit board 171 in a chip form, and in this case, a directional angle of the LED 173 may be 115 degrees or more, for example, 118 degrees or more, and is not limited thereto. Such a directional angle of the LED 173 may vary depending on a structure of a package or a shape of a cavity in a package, and is not limited thereto. The LED 173 may be disposed on the circuit board 171 in one row or two or more rows, and is not limited thereto.

The LED 173 according to an embodiment may include, for example, a warm white LED and a cool white LED on each circuit board 171. The warm white LED and the cool white LED are elements that emit white light. Since the warm white LED and the cool white LED may emit the white light of mixed light by radiating a correlated color temperature, the color rendering index (CRI), which is close to natural sunlight becomes high. Accordingly, it is possible to prevent a color of an actual object from being distorted, thereby reducing fatigue of a user's eyes.

As shown in FIG. 3, the first light-transmitting sheet 180 may be disposed on the first recess 115 and the second light-transmitting sheet 182 may be disposed on the second recess 115A. The first light-transmitting sheet 180 may be inclined with respect to the X-axis direction. The second light-transmitting sheet 182 may be inclined with respect to the X-axis direction. The first and second light-transmitting sheets 180 and 182 may have the same angle in the X-axis direction with respect to a center between the first and second recesses 115 and 115A. The first light-transmitting sheet 180 may be disposed above the horizontal X-Z plane of a bottom of the first recess 115. The second light-transmitting sheet 182 may be disposed above the horizontal X-Z plane of a bottom of the first recess 115A.

Upper end portions of the first and second light-transmitting sheets 180 and 182 may be disposed higher than lower end portions thereof. The lower end portions of the first and second light-transmitting sheets 180 and 182 may be disposed closer to the heat radiator 150 than the upper end portions. The first and second light-transmitting sheets 180 and 182 may have a gradually higher height as they become farther from the heat radiator 150.

The first recess 115 has a first protrusion 125 on an inner side, and the first protrusion 125 may protrude in an inward direction of the first recess 115 or in the direction of the heat radiator 150. The first protrusion 125 may be formed to be long in the Z-axis direction. The first and second protrusions 125 may have a first groove 118 at an upper portion thereof. The second recess 115A has a second protrusion 125A on an inner side, and the second protrusion 125A may protrude in an inward direction of the second recess 115A or in the direction of the heat radiator 150. The second protrusion 125A may be formed to be long in the Z-axis direction.

The first and second protrusions 125 and 125A may be disposed at a predetermined position on inner surfaces of the first and second recesses 115 and 115A, and for example, may be disposed at an outer side of a center of the first and second recesses 115 and 115A. The first and second protrusions 125 and 125A protrude from upper surfaces of the back covers 111 and 112 in the directions of the first and second recesses 115 and 115A. The first and second protrusions 125 and 125A may be disposed along the second Z-axis direction in a center of the upper surface of the first and second recesses 115 and 115A. The first and second protrusions 125 and 125A may be disposed in outer peripheries of the upper end portions of the first and second light-transmitting sheets 180 and 182. The first and second protrusions 125 and 125A may have the same material as or a different material from that of the first and second back covers 111 and 112, and are not limited thereto.

The upper end portion of the first light-transmitting sheet 180 may be placed on the first protrusion 125 of the first recess 115. The upper end portion of the first light-transmitting sheet 180 may be inserted into the first groove 118. The lower end portion of the first light-transmitting sheet 180 may be disposed in the second groove 158 between the first reflector 153 of the heat radiator 150 and the front cover 155. The second groove 158 may be formed by the first reflector 153 of the heat radiator 150 and the front cover 155. The upper end portion of the second light-transmitting sheet 182 may be placed on the second protrusion 125A of the second recess 115A. The upper end portion of the second light-transmitting sheet 182 is disposed in the first groove 118 and the lower end portion thereof may be disposed in the second groove 158 between the second reflector 153A of the heat radiator 150 and the front cover 155. The second groove 158 may be formed by the second reflector 153A of the heat radiator 150 and the front cover 155.

The light-transmitting sheets 180 and 182 may be a sheet having a diffusing agent or may include a diffusion sheet material. The light-transmitting sheets 180 and 182 may include a diffusion sheet, for example, at least one of polymethyl methacrylate (PMMA), polypropylene (PP), polyethylene (PE), and polystyrene (PS).

The light-transmitting sheets 180 and 182 may include a plurality of layers, for example, a diffusion film and a diffusion plate on the diffusion film. The diffusion film may include at least one of polyethylene terephthalate (PET), PS, and PC, and the diffusion plate may include at least one of PC, PS, and PMMA. The diffusion film diffuses incident light, and the diffusion plate has a thickness larger than a thickness of the diffusion film, diffuses light passing through the diffusion film, and prevents from sagging down.

Since the first recess 115 of the first back cover 111 is disposed in the same structure as the second recess, hereinafter, a structure of the second recess will be omitted, and the first recess will be described. The second recess and the second light-transmitting sheet will be described with reference to the description of the first recess and the first light-transmitting sheet.

Referring to FIGS. 8 and 9, the first light-transmitting sheet 180 may be disposed in an oblique direction with respect to an optical axis X0. The optical axis X0 may be an axial direction perpendicular to an emitting surface of the LED 173. The optical axis X0 may be parallel to the first X-axis direction.

Here, the upper end portion of the first light-transmitting sheet 180 may be disposed on the first protrusion 125 and the lower end portion thereof may be disposed on the cover plate 156 of the front cover 155. The front cover 155 or the cover plate 156 may be disposed at a position lower than the first protrusion 125.

The first light-transmitting sheet 180 may be inclined at a predetermined angle θ1 with respect to the X-axis direction of the housing 110. The light-transmitting sheet 180 may be disposed in a shape inclined with respect to the optical axis X0 in the first recess 115 of the first back cover 111. The inclined angle θ1 of the first light-transmitting sheet 180 may be 45 degrees or less with respect to the X-axis direction of the housing 110. The angle θ1 may be inclined in a range of 9 to 13 degrees, for example, in a range of 11 to 12 degrees with respect to the optical axis X0. When the inclined angle θ1 of the first light-transmitting sheet 180 is out of the above range, a distribution of light reflected in the recess 115 may not be uniform and an uniform luminance distribution may not be provided by the light directly incident on the first light-transmitting sheet 180. By being inclined at the angle θ1, such a light-transmitting sheet 180 may correspond to the LED 173 in the horizontal direction. The first light-transmitting sheet 180 may receive and diffuse light reflected via a surface of the first recess 115 so as to irradiate the light.

The light emitting surface of the LED 173 or a back surface of the circuit board 171 may be disposed at a right angle or in a range of 89 to 91 degrees with respect to the first X-axis. Accordingly, light emitted from the LED 173 may be directly irradiated onto entire regions B1, B2, and B3 of the first light-transmitting sheet 180. The first light-transmitting sheet 180 may directly receive and diffuse light emitted from the LED 173 by the inclined angle θ1. As another example, when the LED 173 is out of the angle with respect to the first X-axis, light emitted from the LED 173 may not be irradiated to a partial region of the first light-transmitting sheet 180, and the reflected light may be used.

Referring to FIGS. 8 to 10, in the first recess 115, reflective regions M1, M2, and M3 for changing a path of light emitted from the LED 173 may be disposed, or reflective sheets 160 and 165 may be attached on at least one of the reflective regions M1, M2 and M3.

The inner surface of the back cover 111 may have a plurality of reflective regions M1 and M2 disposed between the LED 173 and the upper end portion of the light-transmitting sheet 180. The reflective regions M1 and M2 may include a first reflective region M1 adjacent to the LED 173 and a second reflective region M2 disposed between the first reflective region M1 and the upper end portion of the light-transmitting sheet 180.

The first reflective region M1 may be a section from a highest point of the first recess 115 to a point adjacent to the LED 173 on an inner side surface of the first recess 115. The second reflective region M2 may be a section from the highest point of the first recess 115 to a point adjacent to the upper end portion of the light-transmitting sheet 180 on the inner side surface of the first recess 115. That is, a boundary between the first and second reflective regions M1 and M2 may be a highest point portion of the first recess 115, and is not limited thereto.

The first reflective region M1 may reflect first side light L1 from light emitted from the LED 173 to the second reflective region M2. The second reflective region M2 may reflect light emitted from the LED 173 and light reflected from the first reflective region M1 to the light-transmitting sheet 180. The first reflective region M1 may include a plurality of reflective surfaces or inclined surfaces having different radii of curvature. The second reflective region M2 may include a plurality of reflective surfaces or planes having different radii of curvature.

Referring to FIGS. 8 and 9, the first reflective region M1 is a regular reflection region and the second reflective region M2 is an irregular reflection region for incident light L1, L2, and L3. The first and second reflective regions M and M2 may be disposed above the optical axis X0. In addition, the latching protrusion 125 may be spaced apart from the optical axis X0 by a predetermined distance d1.

The first and second reflective regions M1 and M2 may be disposed in a directional angle region with respect to the optical axis X0 of the LED 173. Both ends of the first reflective region M1 may form an angle R3 ranging from 28 to 33 degrees with the LED 173 as a starting point P. When the angle R3 between both ends of the first reflective region M1 and the starting point P of the LED 173 is larger than the above range, light that is regularly reflected from the first reflective region M1 may be irradiated to the light-transmitting sheet 180 to generate a bright line on the light-transmitting sheet 180. When the angle R3 is smaller than the above range, light that is regularly reflected from the first reflective region M1 is not uniformly irradiated to the second reflective region M2, and thus a light distribution is not uniform. The first reflective region M1 may be disposed in an angle range that allows the right side light L1 incident thereon to be regularly reflected to different regions of the second reflective region M2. Here, the starting point P may be a center of an emitting surface of the LED 173.

The angle R3 may be wider than an angle R4 formed by both ends of the second reflective region M2 with the LED 173 as a starting point P. Both ends of the second reflective region M2 may form an angle ranging from 21 to 26 degrees with respect to the LED 173 as a starting point P, and the angle may be smaller than the angle R3 formed by the first reflective region M1. As both ends of the second reflective region M2 are disposed at the angle R4 at a center of an emitting surface of the LED 173 as a starting point P, light reflected via the first reflective region M1, light reflected via the third reflective region M3, and light emitted from the LED 173 may be irregularly reflected to be irradiated an entire region of the light-transmitting sheet 180. When the second reflective region M2 is larger than the angle R4, luminous intensity may be lowered, and when the second reflective region M2 is smaller than the angle R4, light uniformity may be lowered.

A starting point P of the LED 173 is a center of an emitting surface and a straight line perpendicular to the emitting surface may be defined as the optical axis X0. The light-transmitting sheet 180 may have a first point Px intersecting with the optical axis X0, and the first point Px may be a point of ½ or more from an upper end of the light-transmitting sheet 180, for example, may be a point of ⅔. In addition, a second point Py may be a point of ⅓ from the upper end of the light-transmitting sheet 180.

The upper end of the light-transmitting sheet 180 and the first point Px may have an angle R1 less than 10 degrees from the LED 173 as a starting point P, and is not limited thereto. When the angle R1 is 10 degrees or more, a bright line may be generated by light directly incident on the light-transmitting sheet 180. The angle R1 may vary depending on a tilting angle of the light-transmitting sheet 180, and is not limited thereto.

As a starting point P of the LED 173, an angle R1+R2 formed by both ends of the light-transmitting sheet 180 may be greater than the angle R3 or R4 formed by the first reflective region M or the second reflective region M2, for example, in a range of 34 to 39 degrees. When the angle R1+R2 formed by both ends of the light-transmitting sheet 180 is smaller than the above range, a diffusion effect of light may be reduced and a light uniformity may be reduced, and when the angle R1+R2 formed by both ends of the light-transmitting sheet 180 is larger than the above range, a generation of the bright line may be increased by light incident directly.

The reflector 153 may be a third reflective region M3 and the third reflective region M3 may reflect incident light to the second reflective region M2 and/or the light-transmitting sheet 180. As a starting point P of the LED 173, an angle R5 formed by both ends of the lower third reflective region M3 may be greater than the angle R3 or R4 formed by the first reflective region M1 or the second reflective region M1. The third reflective region M3 may be a regular reflection region or an irregular reflection region. The third reflective region M3 may reflect incident light to the second reflective region M2 and the light-transmitting sheet 180 to suppress a generation of a bright line in the light-transmitting sheet 180. A region of the third reflective region M3 adjacent to the LED 173 may cover a region of the LED 173, which is out of a directional angle, thereby reducing light leakage.

At least one of the reflective regions M1, M2, and M3 may include a reflective sheet. For example, as shown in FIGS. 9 and 10, reflective sheets 160, 165 and 162 may be disposed on the inner surface of the back cover 111 and on the reflector 153. The reflective sheets 160, 165, and 162 may include first to third reflective sheets 160, 165, and 162 disposed in different regions.

The first reflective sheet 160 may be disposed in the first reflective region M1 and the second reflective sheet 165 may be disposed in the second reflective region M2. The third reflective sheet 162 may be disposed in the third reflective region M3. The first reflective sheet 160 may be attached to a surface of a region adjacent to the LED 173 from a highest point of the recess 115 in inner surfaces of each recesses 115. The second reflective sheet 165 may be attached to a region adjacent to the upper end portion of the light-transmitting sheet 180 from the highest point of the recess 115 in inner surfaces of each recess 115. That is, a boundary portion between the first and second reflective sheets 160 and 165 may be a highest point portion of the recess 115.

The third reflective sheet 162 may be disposed adjacent to the LED 173 rather than the first reflective sheet 160. The first and second reflective sheets 160 and 165 may be disposed to correspond to the light-transmitting sheet 180. As shown in FIG. 8, both ends of the first reflective sheet 160 may be disposed in a range of the angle R3 at a center of an emitting surface of the LED 173 as a starting point P, both ends of the second reflective sheet 165 may be disposed in a range of the angle R4 at a center of an emitting surface of the LED 173 as a starting point P1, and both ends of the third reflective sheet 162 may be disposed in a range of the angle R5 at a center of an emitting surface of the LED 173 as a starting point P2.

As shown in FIGS. 9 and 10, a gap G1 between the light-transmitting sheet 180 and the upper surface of the first recess 15 becomes narrower toward the latching protrusion 125 with respect to a center of the upper surface of the first recess 115. Such a gap G1 may be a space in which light is mixed on the light-transmitting sheet 180.

The first reflective sheet 160 may include a material different from that of the second reflective sheet 165. The first reflective sheet 160 may include a regular reflective sheet or a mirror sheet, and the second reflective sheet 165 may include an irregular reflective sheet or a white sheet. The first reflective sheet 160 includes Ag and Al materials. The second reflective sheet 165 may be a white plastic material, for example, polycarbonate (PC) or polypropylene (PP), or may include a nano-coating layer, or a metal layer or a resin layer having a pattern formed thereon.

The third reflective sheet 162 may include an irregular reflective sheet or a white sheet, or may include the same material as that of the second reflective sheet 165. As another example, the third reflective sheet 162 may include a regular reflective sheet.

Here, as shown in FIGS. 11 and 12, when the third reflective sheet 162 is an Ag sheet, the second side light L2 of the LED 173 is incident on and reflected by the third reflective sheet 162, and light L10 and L11 reflected from the third reflective sheet 162 may be irregularly reflected by the second reflective sheet 165. For example, some light L10 of the light L10 and L11 reflected from the third reflective sheet 162 may be sufficiently diffused by the gap G1 with the light-transmitting sheet 180 and may be incident on the light-transmitting sheet 180. However, when some light L11 of the light L10 and L11 reflected from the third reflective sheet 162 is diffused by the third reflective sheet 162 adjacent to the upper end portion of the light-transmitting sheet 180, the light diffusion is not performed by the narrow gap G1 and the light has a non-uniform distribution in an upper end region B11 of the light-transmitting sheet 180.

In an embodiment, by arranging the third reflective sheet 162 as the diffusion sheet or the irregular reflective sheet, even when the gap G1 between the light-transmitting sheet 180 and the second reflective sheet 165 becomes narrow, a non-uniform distribution due to light reflected from the third reflective sheet 162 in the upper end region B11 of the light-transmitting sheet 180 can be improved. As another example, the third reflective sheet 162 may include a regular reflective sheet.

Referring to FIGS. 8 to 10, the first, second, and third reflective sheets 160, 165, 162 according to an embodiment may include curved surfaces having a plurality of inflection points, and such a curved surface can reflect light to a desired optical path.

The first and second reflective sheets 160 and 165 include a material having a light reflectance of 90% or more, and light incident by such light reflectance may be reflected without loss, and thus a light extraction effect can be improved.

Here, at least one of the first and second reflective sheets 160 and 165 may be removed, and is not limited thereto.

When light reflected from the first and third reflective sheets 160 and 162 is irregularly reflected by the second reflective sheet 165 and is incident on the different regions B1, B2, and B3, the light-transmitting sheets 180 and 182 diffuse and transmit the incident light. Accordingly, it is possible to prevent an occurrence of a bright line in the light-transmitting sheets 180 and 182 by the directly incident light and the indirectly incident light, and to prevent glare.

A minimum distance between a center of an emitting surface of the LED 173 and the first reflective sheet 160 may be 8 mm or more, for example, in a range of 9 to 11 mm. When the minimum distance between the center of the emitting surface of the LED 173 and the first reflective sheet 160 is smaller than the above range, light out of a directional angle may be incident, and thus improvement of the reflection efficiency may be insignificant. When the minimum distance between the center of the emitting surface of the LED 173 and the first reflective sheet 160 is larger than the above range, a path of light reflection may be difficult to control and leakage of the side light may occur.

A minimum distance between a center of an emitting surface of the LED 173 and the third reflective sheet 162 may be 5 mm or less, for example, in a range of 4 to 4.8 mm. When such a minimum distance is smaller than the above range, the mounting of the circuit board 171 may not be easy, and when such a minimum distance is greater than the above range, leakage of the side light may occur.

A minimum distance between a center of an emitting surface of the LED 173 and the light-transmitting sheet 180 may be at least twice a minimum distance between the LED 173 and the first reflective sheet, for example, may range from 20 to 23 mm. When a minimum distance between a center of the LED 173 and the light-transmitting sheet 180 is larger than the above range, an inclination becomes too large, and thus it is difficult to uniformly control a light distribution. When the minimum distance between the center of the LED 173 and the light-transmitting sheet 180 is smaller than the above range, hot spots or bright lines may occur.

The first reflective sheet 160 may include a plurality of reflective surfaces having different radii of curvature, and the plurality of reflective surfaces may include curved surfaces having a positive radius of curvature. The radius of curvature of the plurality of reflective surfaces may become larger as a distance from the LED 173 increases. The plurality of reflective surfaces may be in at least three, and may include, for example, three to five surfaces. When the number of the reflective surfaces is too small, it is difficult to control a dispersion of light, and when the number of the reflective surfaces is too large, luminous intensity of the reflected light may be lowered. Each of the plurality of reflective surfaces may reflect incident light to different regions of the second reflective sheet 165.

The third reflective sheet 162 may be disposed between the lower end portion of the light-transmitting sheet 180 and the LED 173. The third reflective sheet 162 may be disposed between the lower end portion of the light-transmitting sheet 180 and the front cover 155. The third reflective sheet 162 may include a plurality of reflective surfaces having different radii of curvature. The reflective surface of the third reflective sheet 162 may have a larger radius of curvature as the surface becomes farther from the LED 173.

Since the third reflective sheet 162 is disposed in a parabolic shape in a region between the LED 173 and the light-transmitting sheet 180 to reflect incident light to the second reflective sheet 165 and the light-transmitting sheet 180, the third reflective sheet 162 may uniformly irradiate light to the light-transmitting sheet 180 to suppress a generation of a bright line due to the light directly irradiated.

The first and third reflective sheets 160 and 162 may irradiate light to the center region B2 of the light-transmitting sheet 180, and thus in the center region B2, a bright line formed by main light directly irradiated from the LED 173 can be reduced by indirectly incident light.

Since the second reflective sheet 165 according to an embodiment irregularly reflects light incident from the first reflective sheet 160 and the LED 173 to uniformly irradiate the center region B2 of the light-transmitting sheet 180 with the light, it is possible to suppress a generation of a bright line due to the light directly incident on the light-transmitting sheet 180 from the LED 173. In addition, light reflected by the third reflective sheet 162 may be irregularly reflected by the second reflective sheet 165 or may be irradiated onto the upper regions B1 and B2 of the light-transmitting sheet 180, so that a bright line caused by light directly incident on the light-transmitting sheet 180 from the LED 173 may be removed.

The first to third reflective sheets 160, 165 and 162 improve uniformity of a distribution of light directly irradiated to the light-transmitting sheets 180 and 182 by the LED 173, thereby eliminating a bright line of a light-incident portion.

Reviewing a unified glare rating (UGR) of a lighting device of the present invention, the UGR is 19 or less, indicating that a user does not have any unpleasant glare. In the CIE standard, it is classified that the user has an unpleasant feeling when the UGR is 21 or more.

Table 1 shows UGR, light efficiency, and light uniformity of a lighting device according to an embodiment.

TABLE 1

| UGR | | | |
|---|---|---|---|
| Endwise (horizontal) | Crosswise (portrait) | Light efficiency | Uniformity |
| 18.2 | 19.0 | 85.1% | 82.2% |

Here, the size of the lighting device is 550 to 600 mm×550 to 600 mm, and a thickness or height ranges from 50 to 52 mm. The directional angle of the LED may also be in the range of 120 degrees±5%.

Referring to FIGS. 1 and 13, a plurality of fastening protrusions 90 may be disposed at a predetermined interval in the Z-axis direction in a center region of the housing 110, and the fastening protrusions 90 may protrude in a downward direction of the Y-axis. A center side interval K1 may be narrower or wider than a side interval K2 in the intervals K1 and K2 between the plurality of fastening protrusions 90, and is not limited thereto. The front cover 155 may be fixed to the housing 110 together with the heat radiator 150 by the fastening protrusions 90.

FIGS. 14 to 16 are other examples of the front cover according to an embodiment.

Referring to FIG. 14, the front cover 155 includes a fixing frame 157 and a cover plate 156 extending in both lateral directions below the fixing frame 157.

The fixing frame 157 has a fastening hole and may be fastened to the housing 110 by a fastening part 19 together with the heat radiator 150 of FIG. 14. The fixing frame 157 may have a space 157A in which a lower portion of the fastening part 19 is disposed.

An upper surface 70 of the cover plate 156 may have an inclined surface and a lower surface thereof may provide a plurality of concave-convex structures 71 and 72. The inclined upper surface 70 may be extended so as to be in contact below the lower end portions of the light-transmitting sheets 180 and 182 of FIG. 12 toward an outward direction (for example, X-axis direction) from a center of the cover plate 156. That is, an inclined angle of the upper surface 70 of the cover plate 156 may be the same as an inclined angle θ1 of the light-transmitting sheet 180 of FIG. 9. As another example, an outer side portion of a step structure 70A in the upper surface 70 of the cover plate 156 may be disposed at the same angle as the inclined angle θ1 of the light-transmitting sheet 180, and an inner side portion of the step structure 70A may be disposed at an angle different from the inclined angle θ1 of the light-transmitting sheet 180, for example, may be disposed at a smaller or larger angle than the angle θ1.

A lower portion of the cover plate 156 may include an inner side region C1 and an outer side region C2 having the concave-convex structures 71 and 72. The inner side region C1 may be provided as a flat surface to secure rigidity at a center side of the front cover 155. The flat inner side region C1 may be a region overlapping with a region of the fixing frame 157 in a vertical direction.

The step structure 70A may be provided at an outer side of the upper surface 70 of the cover plate 156 of the front cover 155, and the step structure 70A corresponds to the light leakage-preventing protrusions 62 of the reflectors 153 and 153A of the heat radiator 150 shown in FIG. 14 and thus light leakage caused by the light-transmitting sheets 180 and 182 can be reduced.

The outer side region C2 having the concave-convex structures 71 and 72 may be disposed at an outer side of the inner side region C1, may be a region not overlapping with the fixing frame 157 in a vertical direction, and may be a region overlapping with the recesses 115 and 115A shown in FIG. 12 in the vertical direction. The outer side region C2 may become gradually thicker toward an outward direction from a center of the cover plate 156.

In the concave-convex structures 71 and 72, the concave portion 71 and the convex portion 72 may be alternately disposed. A depth of the concave portion 71 in the concave-convex structures 71 and 72 may gradually increase toward an outward direction, and a length of the convex portion 72 may gradually increase toward the outward direction. When such a front cover 155 is provided with the concave-convex structures 71 and 72 at a lower portion thereof and is formed of a metal material, a heat dissipation surface area may be increased. The concave portion 71 and the convex portion 72 may be disposed to have the same length in the second Z-axis direction as that of the front cover 155, and are not limited thereto.

Referring to FIG. 15, the front cover 155 includes a fixing frame 157 and a cover plate 156 extending in opposite directions below the fixing frame 157.

Referring to FIG 16, the cover plate 156 may have a concave portion 73 recessed in an upward direction or in the direction of the heat radiator 150 in FIG. 14 toward a center of an inner side portion 74, and an outer angle θ2 thereof may be disposed as an obtuse angle. An outer side portion 75 of the cover plate 156 may be bent from the inner side portion 74 and may include a step structure 75A. The outer side portion 75 may be bent in a downward direction of the lower end portions of the light-transmitting sheets 180 and 182 shown in FIG. 14.

The outer side portion 75 of the cover plate 156 provides a step structure 75A. The step structure 75A may correspond to the light leakage-preventing protrusions 62 of the reflectors 153 and 153A of the heat radiator 150 of FIG. 12, may facilitate an insertion of the light-transmitting sheets 180 and 182, and thus may prevent a light leakage.

Referring to FIG. 17, the front cover 155 includes a fixing frame 157 and a cover plate 156 disposed below the fixing frame 157. Two frames 78 and 79 may be disposed spaced apart from each other in parallel at the fixing frame 157 with a predetermined space. A fastening part may be fastened to the spaced space 77.

As another example, the fixing frame 157 may include latching ribs 78A and 79A, which are bent in an outward direction from the frames 78 and 79, and the latching ribs 78A and 79A may be latched and coupled to the lower frame 159B of the heat radiator 150 shown in FIG. 14.

As another example, the fixing frame 157 may have a hook structure and be coupled to the heat radiator 150 of FIG. 14. As another example, the heat radiator 150 of FIG. 14 may have a hook structure and be coupled to the housing 110 via the hook structure.

FIG. 18 is a view illustrating a latching jaw disposed on an inner sidewall of a housing of FIG. 1, FIG. 19 is a perspective view of a housing of FIG. 1 before a front cover is coupled, FIG. 20 is a view illustrating a latching jaw and a light-transmitting sheet in an inner sidewall of a housing in FIG. 19, FIG. 21 is a view illustrating a front cover and a light-transmitting sheet on a latching jaw of a housing in FIG. 19, FIG. 22 is a partially enlarged view of FIG. 21, FIG. 23 is a view illustrating an example in which a light-transmitting sheet and a front cover are coupled on a latching jaw in FIG. 19, and FIG. 24 is a view illustrating a latching jaw of a housing, a light-transmitting sheet, and a front cover in FIG. 23.

Referring to FIGS. 18 and 19, the housing 110 may include first and second latching jaws 121 and 123 protruding from both sidewalls of the Z-axis direction of the first and second recesses 115 and 115A. The first and second latching jaws 121 and 123 may be disposed to face each other with respect to the second Z-axis direction, and may extend from both sides of the connection portion 117 of the housing 110 to both sides of each of the first and second latching protrusions 125 and 125A.

Each of the latching jaws 121 and 123 may include first supporting portions 21 disposed on both sides of the first light-transmitting sheet 180 in the second Z-axis direction, second supporting portions 23 disposed on both sides of the second light-transmitting sheet 182 in the second Z-axis direction, and a light leakage-preventing portion 25 configured to protrude from a region between the first and second supporting portions 21 and 23 and face one sides of lower end portions of the first and second light-transmitting sheets 180 and 182.

A lower surface of the first supporting portion 21 may be inclined along an inclined angle of the first light-transmitting sheet 180, and a lower surface of the second supporting portion 23 may be inclined along an inclined angle of the second light-transmitting sheet 182. The light leakage-preventing portion 25 may be formed in a shape to be in contact with an inner side of the cover plate 156 of the front cover 155. The light leakage-preventing portions 25 may be disposed below both sides of the cover plate 156 in the second Z-axis direction.

The light leakage-preventing portion 25 protrudes from a center of the housing 110 toward a lower surface of the housing 110 further than the first and second supporting portions 21 and 23.

As shown in FIGS. 21 to 24, a lower surface of the light leakage-preventing portion 25 may be spaced apart from a lower surface edge 114 of the housing 110 and the cover plate 156 of the front cover 155 may be disposed in the spaced apart portion. Accordingly, the cover plate 156 may extend to the lower surface of the light leakage-preventing portion 25 of the latching jaws 121 and 123 and to inner sides of the light-transmitting sheets 180 and 182, thereby reducing light leakage.

The lower surface of the light leakage-preventing portion 25 of the latching jaws 121 and 123 may be formed along a surface of the cover plate 156 of the front cover 155. As shown in FIGS. 21 and 22, the light leakage-preventing portion 25 includes a first step structure 33 having a stepped height T2 with respect to the lower surface of the first supporting portion 21, and a second step structure 33A having a stepped height T2 with respect to the lower surface of the second supporting portion 23.

Such first and second step structures 33 and 33A may have a height T2 greater than a thickness T1 of the light-transmitting sheets 180 and 182 and may face one sides of the light-transmitting sheets 180 and 182. In addition, both sides of the front cover 155 covers the lower surface of the light-leakage-preventing portion 25 of the latching jaws 121 and 123, a gap 35 between the light leakage-preventing portion 25 and the first light-transmitting sheet 180, and a gap 35A between the light leakage-preventing portion 25 and the second light-transmitting sheet 182. Accordingly, light leaked to one side through an inside of the light-transmitting sheets 180 and 182 may be reflected by the first and second step structures 33 and 33A, and may be blocked by the front cover 155. Accordingly, it is possible to prevent an occurrence of a light leakage via a region between the front cover 155 and the housing 110.

The cover plate 156 of the front cover 155 may be formed with a stepped structure 53 on an outer side 52 of a lower surface 51, and the stepped structure 53 may be disposed in a region between the light-transmitting sheets 180 and 182 and the light leakage-preventing portion 25 or disposed on the light leakage-preventing protrusion 62 of the heat radiator 150, and thus light transmitted through one side surface of the light-transmitting sheets 180 and 182 can be blocked.

Referring to FIGS. 20 to 22, the light leakage-preventing portion 25 of the latching jaws 121 and 123 and the light leakage-preventing protrusion 62 of the heat radiator 150 may be disposed on one side of a lower end portion of the light-transmitting sheet 180. Since the light leakage-preventing portion 25 of the latching jaws 121 and 123 is disposed on an outer sidewall of the housing 110, the light leakage-preventing portion 25 of the latching jaws 121 and 123 may be disposed further outside than the light leakage-preventing protrusion 62 of the heat radiator 150.

One side of the light-transmitting sheets 180 and 182 may have a gap G3 with the light leakage-preventing portion 25 of the latching jaws 121 and 123 comparable to a predetermined gap 35 or 35A as shown in FIGS. 20 and 24. As shown in FIGS. 20 and 23, one side of the light-transmitting sheets 180 and 182 may be spaced apart from the light leakage-preventing protrusion 62 of the heat radiator 150 at a predetermined gap G2 and G2<G3.

As shown in FIGS. 20 to 24, the gap G3 of the gaps 35 and 35A between the light leakage-preventing portion 25 of the latching jaws 121 and 123 and the light-transmitting sheets 180 and 182 may be disposed to be wider than the gap G2 between the light leakage-preventing protrusion 62 of the heat radiator 150 and the light-transmitting sheets 180 and 182. A gap difference G3−G2 between the gaps 35 and 35A may be generated by an assembly tolerance and the light leakage-preventing portion 25 of the latching jaws 121 and 123 and the front cover 155 may suppress light leakage leaking into the gaps 35 and 35A.

An embodiment can prevent light leakage due to light leaking through one side of a lower end portion of the light-transmitting sheets 180 and 182 by the latching jaws 121 and 123 and the front cover 155 as described above.

Referring to FIGS. 25 to 27, both end portions of the light-transmitting sheets 180 and 182 may be disposed in a latching groove 158 in FIG. 25 between the latching groove 118 of the latching protrusions 125 and 125A and the front cover 155. For example, upper end portions of the light-transmitting sheets 180 and 182 may be disposed on the latching protrusions 125 and 125A, respectively, and lower end portions thereof may be disposed on the cover plate 156 of the front cover 155.

In the light-transmitting sheets 180 and 182, both edges in the first X-axis direction are slidably coupled along the latching protrusions 125 and 125A and the cover plate 156, and both edges in the second Z-axis direction of the light-transmitting sheets 180 and 182 may be placed below the first and second latching jaws 121 and 123 shown in FIG. 18.

As shown in FIG. 27, the latching groove 118 on the latching protrusion 125 is formed to have a height E1 greater than a thickness T1 of the light-transmitting sheet 180, and thus the light-transmitting sheet 180 can be inserted easily. In addition, the latching protrusion 125 may protrude at a predetermined distance E2 in the direction of the first recess 115, and such a distance E2 may be greater than the height E1, and thus the light-transmitting sheet 180 can be prevented from being separated.

The upper and lower end portions of the light-transmitting sheets 180 and 182 are supported by and in close contact with the latching jaws 121 and 123 and the cover plate 156, thereby preventing light leakage from occurring.

<Light Emitting diode>

FIG. 27 is a sectional view showing a light emitting diode according to the embodiment.

Referring to FIG. 27, the light emitting diode 200 includes a body 210; first and second lead electrodes 211 and 213, at least portions of which are disposed in the body 210, a light-emitting device 101 electrically connected to the first and second lead electrodes 211 and 212 on the body 210, and a molding member 220 surrounding the light emitting device 101.

The body 210 may be formed of at least one of a silicon material, a synthetic resin material and a metallic material. The body 210 may include a cavity formed therein and a reflective portion 215 having an inclined surface at the periphery thereof.

The first lead electrode 211 and the second lead electrode 213 are electrically separated from each other, and are formed to pass through the body 210. That is, the inner side portions of the first and second lead electrodes 211 and 212 may be disposed in the cavity and the other portions of the first and second lead electrodes 211 and 212 may be disposed at an outside of the body 210.

The first lead electrode 211 and the second lead electrode 212 provide power to the light-emitting device 100 Also, the first lead electrode 211 and the second lead electrode 213 reflect the light emitted from the light emitting device 101, thus improving the light emitting efficiency. Also, the first lead electrode 211 and the second lead electrode 213 may serve to discharge the heat generated from the light emitting device 101.

The light emitting device 101 may be disposed on the body 210, or may be formed on the first lead electrode 211 and/or the second lead electrode 212. The light emitting device 101 may be arranged as at least one LED (Light Emitting Diode) chip. The LED chip may include a light emitting diode in a visible light band such as red, green, blue or white, or a UV light emitting diode that emits ultraviolet (UV) light. A phosphor layer may be further disposed on the surface of the light emitting device 101, but the present invention is not limited thereto.

The wire 216 of the light emitting device 101 may be electrically connected to at least one of the first and second lead electrodes 211 and 212, but the embodiment is not limited thereto.

The molding member 220 may surround the light-emitting device 101 to protect the light emitting device 101. Also, the molding member 220 may include a fluorescent material to change the wavelength of light emitted from the light emitting device 101. The upper surface of the molding member 220 may be flat, concave or convex. The upper surface of the molding member 220 or the cavity region may be the light emitting surface according to the embodiment, but the present invention is not limited thereto.

A lens may be disposed on the molding member 220, but the present invention is not limited thereto.

The light emitting diode 200 may be a blue light emitting device or a white light emitting device having a high color rendering index (CRI). The light emitting diode may be a light emitting device that emits white light by molding a synthetic resin containing a phosphor on a blue light emitting chip. The phosphor may include at least one of a garnet (YAG, TAG), a silicate, a nitride, and an oxy-nitride.

The features, structures, effects and the like described in the embodiments are included in at least one embodiment of the present invention, and are not necessarily limited to only one embodiment. Furthermore, the features, structures, effects and the like illustrated in the embodiments can be combined and modified by other persons skilled in the art to which the embodiments belong. Therefore, it is to be understood that the present invention is not limited to these embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

An embodiment may be applied to a lighting device for a flat panel.

An embodiment may be applied to a lighting device for a flat panel having a light emitting diode (LED).

The invention claimed is:

1. A lighting device comprising:

a housing having a first back cover and a second back cover on both sides in a first axial direction;

a first recess in which a lower portion of the first back cover is opened;

a second recess in which a lower portion of the second back cover is opened;

a heat radiator disposed between the first and second recesses in a second axial direction perpendicular to the first axial direction at a lower portion of the housing;

a first light-emitting module having a plurality of light emitting diodes (LEDs) in a first region of the heat radiator corresponding to the first recess;

a second light-emitting module having a plurality of LEDs in a second region of the heat radiator corresponding to the second recess;

a first light-transmitting sheet disposed at the first recess so as to be inclined with respect to the first axial direction and configured to diffuse light emitted from the first light-emitting module;

a second light-transmitting sheet disposed at the second recess so as to be inclined with respect to the first axial direction and configured to diffuse light emitted from the second light-emitting module; and a front cover configured to support a lower portion of the heat radiator and lower end portions of the first and second light-transmitting sheets, wherein the front cover comprises a fixing frame protruding to a direction of the heat radiator at the lower portion of the heat radiator, and a cover plate extending to a direction of the lower end portions of the first and second light-transmitting sheets from the fixing frame, and wherein an internal angle between the first light-transmitting sheet and the second light-transmitting sheet is less than 180 degrees.

2. The lighting device of claim 1, wherein the heat radiator comprises:

a first heat dissipation part in which the first light-emitting module is disposed, a second heat dissipation part in which the second light-emitting module is disposed, a first reflector extending from the first heat dissipation part to the lower end portion of the first light-transmitting sheet, a second reflector extending from the second heat radiating part to the lower end portion of the second light-transmitting sheet, and light leakage-preventing protrusion protruding from lower end portions of the first and second reflectors to a direction of the cover plate and facing parts of the first and second light-transmitting sheets.

3. The lighting device of claim 2, wherein an upper surface or a lower surface of the cover plate has a curved surface or an inclined surface.

4. The lighting device of claim 2, wherein both ends of the cover plate extend toward the lower end portions of the first and second light-transmitting sheets and overlap the lower end portions of the first and second light-transmitting sheets in a vertical direction.

5. The lighting device of claim 4, wherein each of the first and second latching jaws comprises first and second supporting portions configured to support both ends of the first and second light-transmitting sheets in the second axial direction, and a light leakage-preventing portion protruding from the first and second supporting portions and facing side surfaces of the lower end portions of the first and second light-transmitting sheets.

6. The lighting device of claim 5, wherein the first and second light-transmitting sheets are inclined with respect to an optical axis of the light emitting diodes (LEDs) of the first and second light-emitting modules.

7. The lighting device of claim 2, comprising: a first reflective sheet adjacent to the first and second light-emitting modules in inner side surfaces of the first and second recesses;

and a second reflective sheet disposed between the first reflective sheet and upper end portions of the first and second light-transmitting sheets in the inner side surfaces of the first and second recesses.

8. The lighting device of claim 7, wherein the first and second reflectors comprise a third reflective sheet having a plurality of reflective surfaces having different radii of curvature thereon.

9. The lighting device of claim 8, wherein the third reflective sheet comprises a regular reflection material or an irregular reflection material, and the third reflective sheet is disposed further adjacent to the LEDs of the first and second light-emitting modules than the first reflective sheet.

10. The lighting device of claim 8, wherein the third reflective sheet overlaps with the front cover in a vertical direction and is disposed below the optical axis of the LEDs of the first and second light-emitting modules.

11. The lighting device of claim 7, wherein the first reflective sheet comprises a regular reflection material and the second reflective sheet comprises an irregular reflection material.

12. The lighting device of claim 11, wherein the first reflective sheet has a plurality of reflective surfaces and a radius of curvature of the plurality of reflective surfaces increases as a distance from a center of the LEDs of the first and second light-emitting modules becomes farther.

13. The lighting device of claim 7, wherein a boundary portion between the first and second reflective sheets is a highest point portion of the first and second recesses.

14. The lighting device of claim 7, wherein the first and second light-transmitting sheets comprises a diffusion sheet and are located at a higher position away from the light emitting diodes of each of the first and second light-emitting modules, and wherein the first and second reflective sheets are disposed above an optical axis of the LEDs of the first and second light-emitting modules.

15. The lighting device of claim 7, wherein each of the first and second recesses has a parabolic shape.

16. The lighting device of claim 15, wherein the first and second light-emitting modules comprise a circuit board on which the LEDs are disposed on the first and second heat dissipation parts, wherein the circuit board is disposed on a vertical surface of the first and second heat dissipation parts in the second axial direction, and the first and second light-transmitting sheets are inclined with respect to the optical axis of the LEDs of the first and second light-emitting module in a range of 9 to 13 degrees, and wherein the first and second reflective sheets are disposed above the optical axis of the LEDs of the first and second light-emitting module.

17. The lighting device of claim 1, wherein both ends of the cover plate extend toward the lower end portions of the first and second light-transmitting sheets and have a height greater than a lower surface of the cover plate.

18. The lighting device of claim 1, comprising:

first and second latching jaws protruding from both sidewalls in the second axial direction in each of the first and second recesses; a first latching protrusion disposed long at an inner side of the first recess in the second axial direction; and a second latching protrusion disposed long at an inner side of the second recess in the second axial direction, wherein the first light-transmitting sheet is disposed on the first and second latching jaws of the first recess and on the first latching protrusion, and the second light transmitting-sheet is disposed on the first and second latching jaws of the second recess and on the second latching protrusion.

19. The lighting device of claim 1, wherein the front cover comprises a plastic material.

20. A lighting device comprising:

a housing having a first back cover and a second back cover on both sides in a first axial direction;

a first recess in which a lower portion of the first back cover is opened;

a second recess in which a lower portion of the second back cover is opened;

a heat radiator disposed between the first and second recesses in a second axial direction perpendicular to the first axial direction at a lower portion of the housing;

a first light-emitting module having a plurality of light emitting diodes (LEDs) in a first region of the heat radiator corresponding to the first recess;

a second light-emitting module having a plurality of LEDs in a second region of the heat radiator corresponding to the second recess;

a first light-transmitting sheet disposed at the first recess so as to be inclined with respect to the first axial direction and configured to diffuse light emitted from the first light-emitting module;

a second light-transmitting sheet disposed at the second recess so as to be inclined with respect to the first axial direction and configured to diffuse light emitted from the second light- emitting module; and a front cover configured to support a lower portion of the heat radiator and lower end portions of the first and second light-transmitting sheets, wherein the front cover comprises a fixing frame protruding to a direction of the heat radiator at the lower portion of the heat radiator, and a cover plate extending to a direction of the lower end portions of the first and second light-transmitting sheets from the fixing frame, wherein an internal angle between the first light-transmitting sheet and the second light- transmitting sheet is less than 180 degrees, wherein a portion of the first light-transmitting sheet faces the plurality of LEDs of the first light-emitting module, and wherein a portion of second light-transmitting sheet faces the plurality of LEDs of the second light-emitting module.

* * * * *